US011282433B2

(12) United States Patent
Yang et al.

(10) Patent No.: US 11,282,433 B2
(45) Date of Patent: Mar. 22, 2022

(54) DISPLAY DEVICE AND METHOD OF DRIVING THE SAME

(71) Applicant: Samsung Display Co., Ltd., Yongin-Si (KR)

(72) Inventors: Su Min Yang, Yongin-si (KR); Wook Lee, Yongin-si (KR); Hye Ji Kim, Yongin-si (KR); Ki Hyun Pyun, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/986,157

(22) Filed: Aug. 5, 2020

(65) Prior Publication Data

US 2021/0150966 A1 May 20, 2021

(30) Foreign Application Priority Data

Nov. 14, 2019 (KR) ..... 10-2019-0145728

(51) Int. Cl.
*G09G 3/20* (2006.01)
*G09G 3/32* (2016.01)

(52) U.S. Cl.
CPC ..... *G09G 3/2007* (2013.01); *G09G 3/32* (2013.01); *G09G 2300/0809* (2013.01); *G09G 2310/027* (2013.01); *G09G 2310/0267* (2013.01); *G09G 2310/08* (2013.01); *G09G 2320/029* (2013.01)

(58) Field of Classification Search
CPC ..... G09G 3/2007; G09G 3/32; G09G 2300/0809; G09G 2300/0819; G09G 2310/0267; G09G 2310/027; G09G 2310/08; G09G 2320/0233; G09G 2320/029; G09G 2320/0295; G09G 2320/043; G09G 2320/045
USPC ..... 345/691
See application file for complete search history.

(56) References Cited

U.S. PATENT DOCUMENTS 9,035,976 B2 5/2015 Lee et al.
9,984,628 B2 5/2018 Bae et al.
9,990,888 B2 6/2018 Oh et al.
10,453,398 B2 * 10/2019 Kishi ..... G09G 3/3291
(Continued)

FOREIGN PATENT DOCUMENTS

KR 10-1528148 B1 6/2015
KR 10-2016-0018946 A 2/2016
(Continued)

OTHER PUBLICATIONS

Extended European Search Report, Application No. 20204503.5 dated Mar. 18, 2021, 11 pages.

*Primary Examiner* — Tom V Sheng
(74) *Attorney, Agent, or Firm* — Innovation Counsel LLP

(57) ABSTRACT

A display device includes first pixels partitioned into a plurality of blocks, each of the plurality of blocks being categorized as a first block or a second block, a sensor configured to generate first sensing data for at least two of the first pixels in each of the plurality of blocks during a first period, and a sensing controller configured to generate interpolated data for the first pixels that are not sensed by the sensor by interpolating the first sensing data, for the first block, and configured to forgo interpolation of the first sensing data, for the second block. The sensor generates second sensing data for the first pixels that are not sensed by the sensor, for the second block, during a second period after the first period.

21 Claims, 20 Drawing Sheets

(56) References Cited

U.S. PATENT DOCUMENTS

| | | | | |
|---|---|---|---|---|
| 2009/0195483 | A1* | 8/2009 | Naugler, Jr. | G09G 3/3233 345/76 |
| 2014/0176401 | A1* | 6/2014 | Kim | G09G 3/3208 345/76 |
| 2015/0379940 | A1* | 12/2015 | Kishi | G09G 3/3283 345/690 |
| 2016/0189618 | A1* | 6/2016 | Park | G09G 3/3258 345/690 |
| 2020/0105179 | A1* | 4/2020 | Greenebaum | G09G 3/2051 |
| 2020/0365091 | A1* | 11/2020 | Pyun | G09G 3/3283 |

FOREIGN PATENT DOCUMENTS

| | | | |
|---|---|---|---|
| KR | 10-2017-0034977 | A | 3/2017 |
| KR | 10-2017-0055067 | A | 5/2017 |
| KR | 10-2019-0066802 | A | 6/2019 |

* cited by examiner

DISPLAY DEVICE AND METHOD OF DRIVING THE SAME

CROSS-REFERENCE TO RELATED APPLICATION

The present application claims priority to Korean patent application number 10-2019-0145728 filed on Nov. 14, 2019, the disclosure of which is incorporated herein in its entirety by reference.

BACKGROUND

1. Technical Field

The present disclosure relates to a display device and a method of driving the display device.

2. Related Art

A display device is frequently used as a medium to connect a user and information. Examples of such display devices include a liquid crystal display (LCD) device, an organic light-emitting display device, and a plasma display device.

The display device may include a plurality of pixels, and the pixels may emit light in various colors and with various luminance levels, thus displaying various images.

The display device may include pixel circuits having the substantially same structure. However, as a display area of the display device increases, process deviations may occur depending on locations of pixels in the display area. For example, pixel transistors that are designed to perform the same function in the respective pixels may exhibit different characteristics, such as mobility or threshold voltages. Similarly, the threshold voltages of light-emitting diodes in the respective pixels may exhibit different characteristics from each other.

Further, in addition to the process deviations, degrees of degradation of elements included in the respective pixels may vary depending on a usage frequency, an ambient temperature, etc. of the corresponding pixels as the display device is being used.

To minimize such process deviations and variations in the pixels, sensors may be used to sense characteristics (e.g., mobility, threshold voltages, etc.) of the pixels. However, it would take a lot of time to sense the characteristics of all pixels. When characteristics of a subset of pixels are sensed and used, the sensed information of the pixels may not provide accurate representation of the all pixels.

SUMMARY

Various embodiments of the present disclosure are directed to a display device and a method of driving the display device, which can accurately sense characteristic information of pixels while reducing the time required to sense the characteristic information.

According to an embodiment of the present disclosure, a display device includes first pixels partitioned into a plurality of blocks, each of the plurality of blocks being categorized as a first block or a second block, a sensor configured to generate first sensing data for at least two of the first pixels in each of the plurality of blocks during a first period, and a sensing controller configured to generate interpolated data for the first pixels that are not sensed by the sensor by interpolating the first sensing data, for the first block, and configured to forgo interpolation of the first sensing data, for the second block, wherein the sensor generates second sensing data for the first pixels that are not sensed by the sensor, for the second block, during a second period after the first period.

The first pixels may have a first color.

The display device may further include second pixels of a second color that is different from the first color, and third pixels of a third color that is different from the first color and the second color, wherein one of the first pixels, one of the second pixels, and one of the third pixels are coupled to the sensor through a common sensing line.

The sensing controller may include a representative block value calculator configured to calculate a representative block value of the first sensing data, for each of the plurality of blocks, a fine sensing decider configured to categorize each of the plurality of blocks as one of the first block and the second block based on the representative block value, and an interpolation calculator configured to generate the interpolated data by interpolating the first sensing data for the first block.

The representative block value may be at least one of a standard deviation value, an average value, a maximum value, and a minimum value of the first sensing data, for each of the plurality of blocks.

The fine sensing decider may be configured to categorize each of the plurality of blocks as the second block based on the standard deviation value being greater than a block threshold value, and categorize each of the plurality of blocks as the first block based on the standard deviation value being less than or equal to the block threshold value.

The interpolation calculator may generate first interpolated data, among the interpolated data, using the first sensing data, and generate second interpolated data using the first interpolated data.

The interpolation calculator may generate of first interpolated data, among the interpolated data, using the first sensing data, and generate second interpolated data using the first interpolated data and the first sensing data.

The display device may further include a timing controller configured to generate grayscale values for the first pixels using the interpolated data and the second sensing data.

According to an embodiment of the present disclosure, a display device includes first pixel, a lookup table including stress values for the first pixels, a sensor configured to generate sensing data for at least some of the first pixels, and a sensing controller configured to generate interpolated data for at least some of the first pixels that are not sensed by interpolating the sensing data with reference to the stress values.

The first pixels may have a first color.

The display device may further include second pixels of a second color that is different from the first color, and third pixels of a third color that is different from the first color and the second color, wherein one of the first pixels, one of the second pixels, and one of the third pixels are coupled to the sensor through a common sensing line.

The sensing controller may include an interpolation group designator configured to designate adjacent first pixels in an interpolation group based on the stress values having a difference therebetween less than or equal to a stress threshold value, and an interpolation calculator configured to generate the interpolated data for respective ones of a plurality of interpolation groups.

The first pixels may be partitioned into a plurality of blocks, and the sensing controller may include a fine sensing decider configured to categorize each of the plurality of blocks as one of a first block and a second block based on a representative stress value of the stress values, for each of the plurality of blocks, and an interpolation calculator configured to generate the interpolated data by interpolating the sensing data for the first block.

The representative stress value may be at least one of a standard deviation value, an average value, a maximum value, and a minimum value of the stress values, for each of the plurality of blocks.

The fine sensing decider may be configured to categorize each of the plurality of blocks as the second block based on the standard deviation value being greater than a stress threshold value, and categorize each of the plurality of blocks as the first block based on the standard deviation value being less than or equal to the stress threshold value.

The sensor may generate first sensing data for at least two of the first pixels that belong to the first block, and generate second sensing data for all of the first pixels that belong to the second block.

According to an embodiment of the present disclosure, a method of driving a display device including pixels partitioned into a plurality of blocks includes generating first sensing data for at least two of pixels in each of the plurality of blocks during a first period, generating interpolated data for a first group of pixels that are not sensed by interpolating the first sensing data, for a first block among the plurality of blocks, and generating second sensing data for a second group of pixels that are not sensed for a second block among the plurality of blocks during a second period after the first period.

The method may further include calculating a representative block value of the first sensing data, for each of the plurality of blocks, and categorizing each of the plurality of blocks as one of the first block and the second block based on the representative block value, wherein the representative block value may be at least one of a standard deviation value, an average value, a maximum value, and a minimum value of the first sensing data, for each of the plurality of blocks.

Categorizing each of the blocks as one of the first block and the second block may include categorizing each of the plurality of blocks as the second block based on the standard deviation value being greater than a block threshold value, and categorizing each of the plurality of blocks as the first block based on the standard deviation value being less than or equal to the block threshold value.

According to an embodiment of the present disclosure, a method of driving a display device including pixels partitioned into a plurality of blocks includes sensing some of pixels in each of the plurality of blocks during a first period, and sensing remaining pixels that are not sensed in at least one of the plurality of blocks during a second period after the first period.

DETAILED DESCRIPTION

Figure 1:
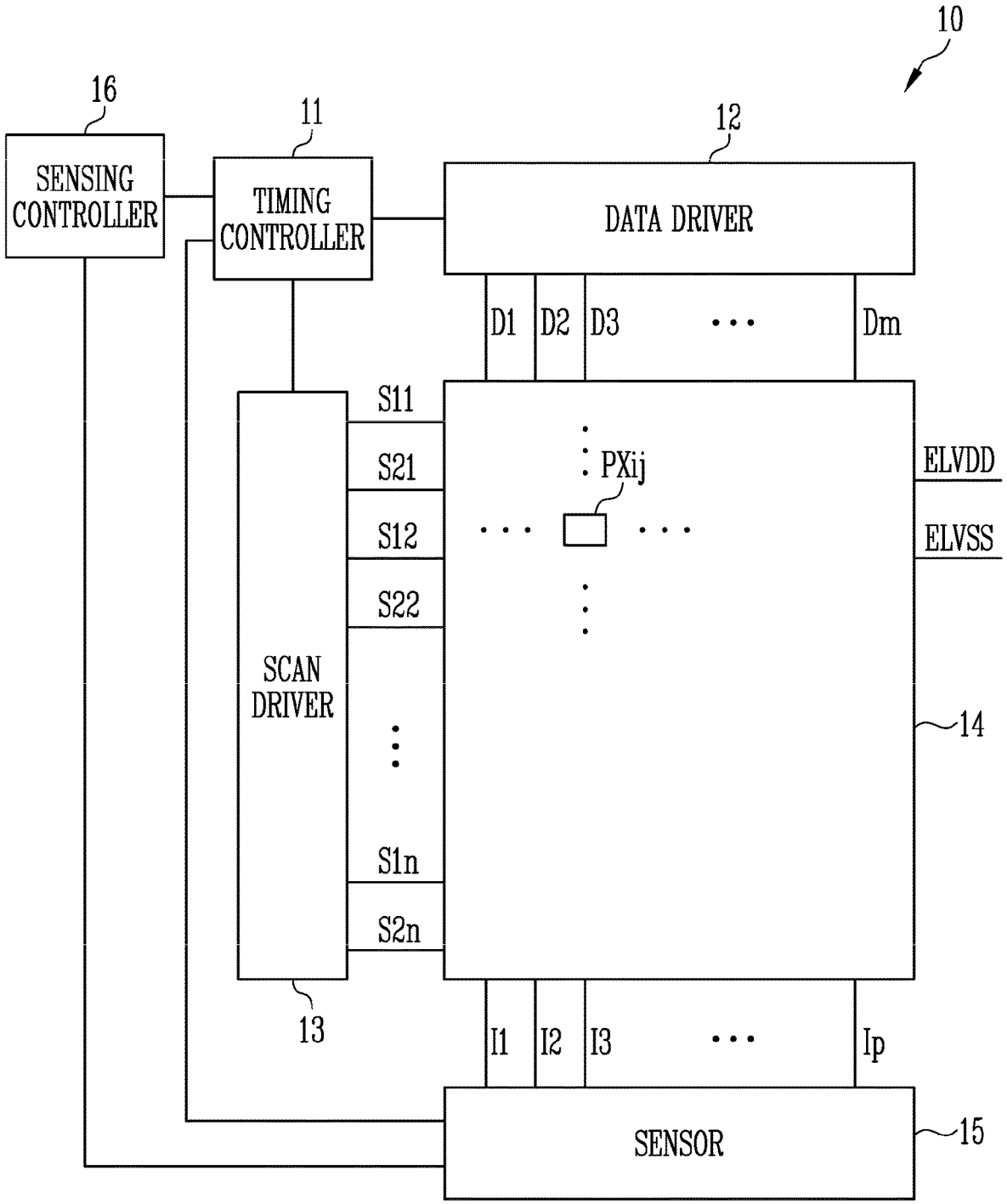
FIG. 1 is a diagram illustrating a display device according to an embodiment of the present disclosure.

Hereinafter, exemplary embodiments of the present disclosure will be described in detail with reference to the attached drawings so that those skilled in the art can easily practice the present disclosure. The present disclosure may be embodied in different forms without being limited to the exemplary embodiments.

Furthermore, in the drawings, portions that are not directly related to the present disclosure will be omitted to explain the present disclosure more clearly and concisely. Reference are made to the drawings, in which similar reference numerals are used throughout the present disclosure to designate similar components. Therefore, reference numerals described in one drawing may be used in other drawings.

Further, since the sizes and thicknesses of respective components are arbitrarily indicated in drawings for convenience of description, the present disclosure is not limited by the drawings. The sizes, thicknesses, etc. of components, layers, and areas in the drawings may be exaggerated to clarify the description thereof.

FIG. 1 is a diagram illustrating a display device according to an embodiment of the present disclosure.

A display device 10 according to an embodiment of the present disclosure may include a timing controller 11, a data driver 12, a scan driver 13, a pixel component 14, a sensor 15, and a sensing controller 16.

The timing controller 11 may receive grayscale values and control signals for each image frame from an external processor (not shown). The timing controller 11 may render the grayscale values suitable for the display device 10. For example, the external processor may provide a red grayscale value, a green grayscale value, and a blue grayscale value for each unit dot. For example, when the pixel component 14 has a pentile structure, adjacent unit dots may share a pixel, and thus pixels may not correspond to respective grayscale values in a one-to-one correspondence. In this case, the rendering of the grayscale values may be required. When pixels correspond to respective pixel values in a one-to-one correspondence, the rendering of the grayscale values may not be required. The grayscale values whether they are rendered or not rendered may be provided to the data driver 12. The timing controller 11 may provide control signals to the data driver 12, the scan driver 13, and the sensor 15 to display an image frame using the pixel component 14.

The data driver 12 may generate data voltages and provide the data voltages to data lines D1, D2, D3, . . . , Dm using the grayscale values and the control signals received from the timing controller 11. For example, the data driver 12 may sample the grayscale values using a clock signal that is received as one of the control signals, and may apply data voltages corresponding to the grayscale values to the data lines D1 to Dm in units of pixel rows. Here, m may be an integer greater than 0.

The scan driver 13 may receive a clock signal, a scan start signal, etc. from the timing controller 11 as the control signals, and may generate first scan signals and provide the first scan signals to first scan lines S11, S12, . . . , S1*n* and second scan signals to second scan lines S21, S22, . . . , S2*n*. Here, n may be an integer greater than 0.

The scan driver 13 may sequentially provide the first scan signals, each having a turn-on level pulse, to the first scan lines S11, S12, . . . , S1*n*, and may sequentially provide the second scan signals, each having a turn-on level pulse, to the second scan lines S21, S22, . . . , S2*n*.

For example, the scan driver 13 may include a first scan driver coupled to the first scan lines S11, S12, . . . , S1*n* and a second scan driver coupled to the second scan lines S21, S22, . . . , S2*n*. Each of the first scan driver and the second scan driver may include scan stages configured in the form of shift registers. Each of the first scan driver and the second scan driver may generate the scan signals in a manner in which a scan start signal having a turn-on level pulse is sequentially transferred to a next scan stage, under the control of the clock signal.

In an embodiment, the first scan signals and the second scan signals may be identical to each other. In this case, a first scan line and a second scan line coupled to each pixel PXji may be coupled to the same node, and the scan driver 13 may be implemented as a single scan driver without being divided into a first scan driver and a second scan driver.

The sensor 15 may receive the control signals from the timing controller 11, and may supply initialization voltages to sensing lines I1, I2, I3, . . . , Ip and/or receive sensing signals from the sensing lines I1, I2, I3, . . . , Ip. For example, the sensor 15 may supply the initialization voltages to the sensing lines I1, I2, I3, . . . , Ip during at least one part of a display period, and may receive sensing signals from the sensing lines I1, I2, I3, . . . , Ip during at least another part of a sensing period. Here, p may be an integer greater than 0.

The sensor 15 may include sensing channels coupled to the sensing lines I1, I2, I3, . . . , Ip. For example, the sensing lines I1, I2, I3, . . . , Ip may correspond to the sensing channels in a one-to-one correspondence.

The pixel component 14 may include a plurality of pixels. Each pixel PXij may be coupled to a data line, a scan line, and a sensing line that respectively correspond to the pixel PXji. The pixels PXij may be partitioned into a plurality of blocks. In one embodiment, each of the blocks may include the same number of pixels, and may not overlap each other. In another embodiment, the blocks may include different numbers of pixels. In some embodiments, the blocks may overlap each other and share at least one or more pixels.

A controller may be provided for each block including a plurality of pixels. The controller may be a virtual or logical group of pixels without being tied to a physical component. In one embodiment, blocks may be defined in a memory before a product is shipped, or may be actively redefined during a use of the product.

The sensing controller 16 may receive sensing data from the sensor 15, generate interpolated data by interpolating the sensing data, and provide the interpolated data to the timing controller 11. The timing controller 11 may generate grayscale values for the pixels in the pixel component 14 using the interpolated data. In an embodiment, the timing controller 11 may generate the grayscale values for the pixels using all of the interpolated data and the sensing data.

The sensor 15 may generate the sensing data by sensing only some pixels or all pixels for each block in response to the control signals that may be supplied from the sensing controller 16 or the timing controller 11.

Figure 2:
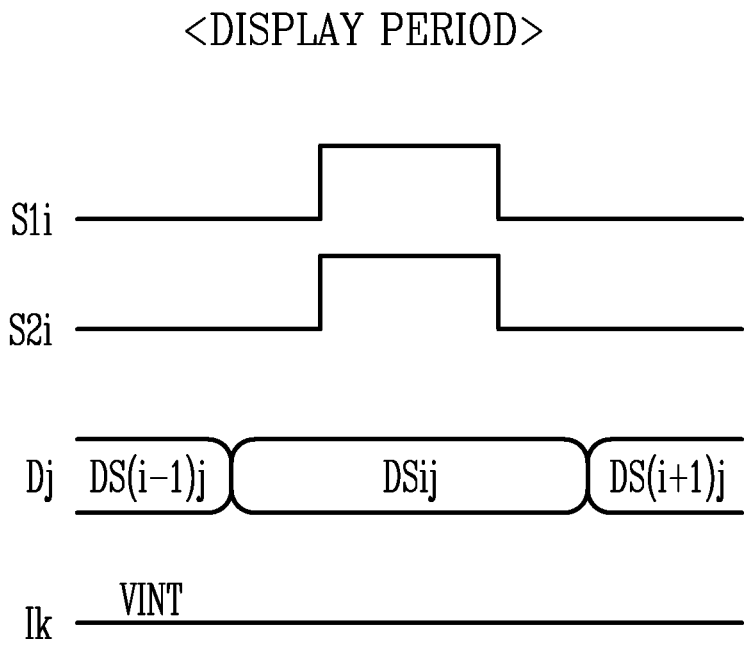
FIG. 2 and FIG. 3 are diagrams for explaining a display period of a pixel according to an embodiment of the present disclosure.
Figure 3:
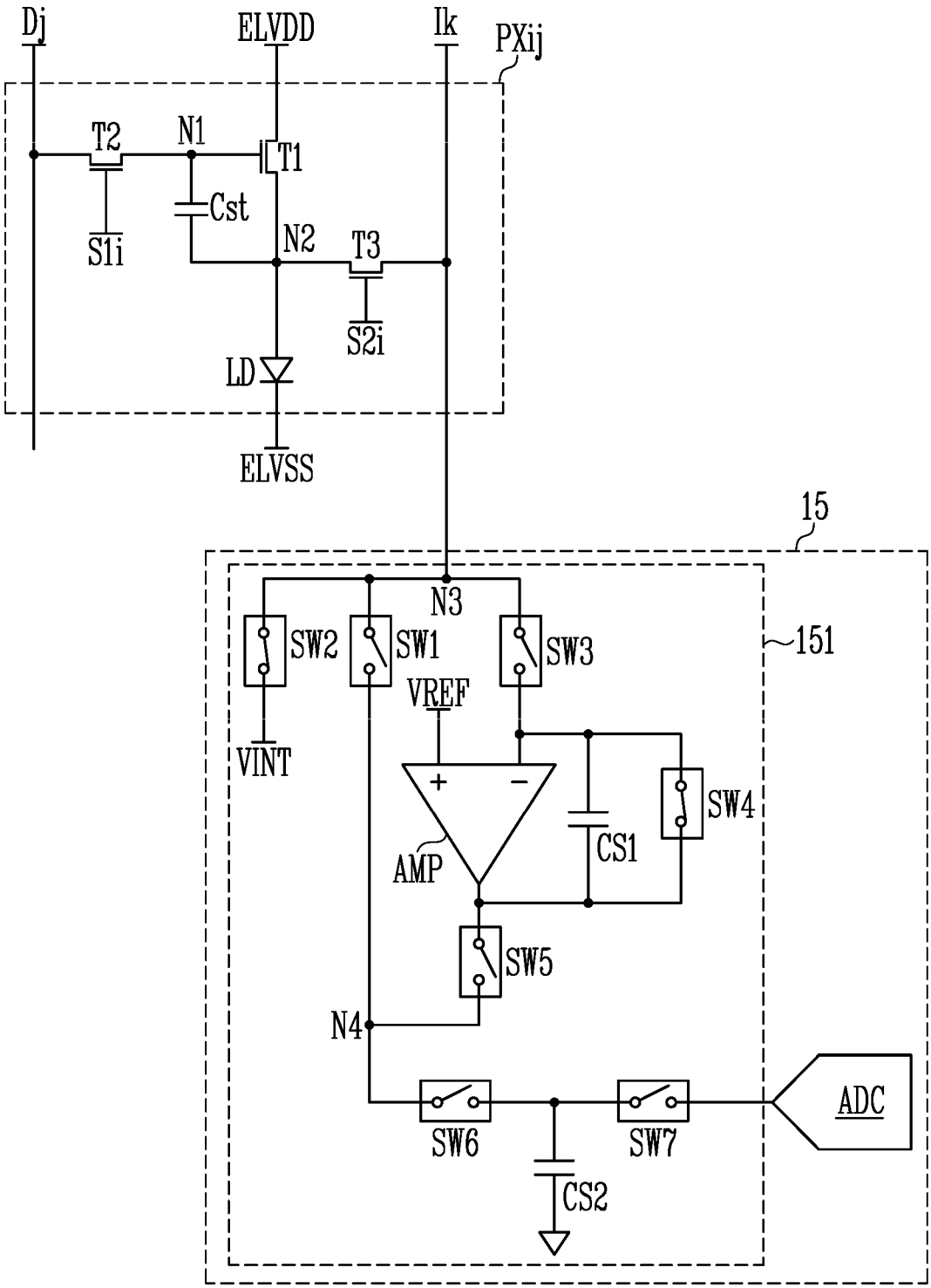

FIGS. 2 and 3 are diagrams for explaining a display period of a pixel according to an embodiment of the present disclosure.

FIG. 2 illustrates exemplary waveforms of signals that are applied to a first scan line S1*i*, a second scan line S2*i*, a data line Dj, and a sensing line Ik that are coupled to a pixel PXij during the display period. Here, k may be an integer greater than 0.

An exemplary configuration of the pixel PXij and a sensing channel 151 will be described below with reference to FIG. 3.

The pixel PXij may include transistors T1, T2, and T3, a storage capacitor Cst, and a light-emitting diode LD.

In one embodiment, the transistors T1, T2, and T3 may be implemented as N-type transistors. In another embodiment, the transistors T1, T2, and T3 may be implemented as P-type transistors. In yet another embodiment, the transistors T1, T2, and T3 may be implemented as a combination of an N-type transistor and a P-type transistor. The term "P-type transistor" refers to a transistor through which an increased amount of current flows as a voltage difference between a gate electrode and a source electrode increases in a negative direction. The term "N-type transistor" refers to a transistor through which an increased amount of current flows as a voltage difference between a gate electrode and a source electrode increases in a positive direction. Each of the transistors T1, T2, and T3 may be implemented as any type of transistors, such as a thin-film transistor (TFT), a field effect transistor (FET), and a bipolar junction transistor (BJT).

The first transistor T1 may have a gate electrode coupled to a first node N1, a first electrode coupled to a first power source ELVDD, and a second electrode coupled to a second node N2. The first transistor T1 may be referred to as a driving transistor.

The second transistor T2 may have a gate electrode coupled to the first scan line S1*i*, a first electrode coupled to the data line Dj, and a second electrode coupled to the first node N1. The second transistor T2 may be referred to as a scanning transistor.

The third transistor T3 may have a gate electrode coupled to the second scan line S2*i*, a first electrode coupled to the second node N2, and a second electrode coupled to the sensing line 11*c*. The third transistor T3 may be referred to as a sensing transistor.

The storage capacitor Cst may have a first electrode coupled to the first node N1 and a second electrode coupled to the second node N2.

The light-emitting diode LD may have an anode coupled to the second node N2 and a cathode coupled to a second power source ELVSS.

Generally, the voltage of the first power source ELVDD may be higher than that of the second power source ELVSS. However, in a special situation, for example, for prevention of light emission by the light-emitting diode LD, the voltage of the second power source ELVSS may be set to a voltage that is equal to or higher than that of the first power source ELVDD.

The sensing channel 151 may include switches SW1 to SW7, a sensing capacitor CS1, an amplifier AMP, and a sampling capacitor CS2.

The second switch SW2 may have a first end coupled to a third node N3 and a second end coupled to an initialization power source VINT.

The amplifier AMP may have a first input terminal (e.g., a non-inverting terminal) coupled to a reference power source VREF, a second input terminal (e.g., an inverting terminal), and an output terminal. The amplifier AMP may be implemented as an operational amplifier.

The third switch SW3 may have a first end coupled to the third node N3 and a second end coupled to the second input terminal of the amplifier AMP.

The sensing capacitor CS1 may have a first electrode coupled to the second input terminal of the amplifier AMP and a second electrode coupled to the output terminal of the amplifier AMP.

The sampling capacitor CS2 may have a first electrode coupled to the sensing capacitor CS1 through the fifth switch SW5 and the sixth switch SW6.

The fourth switch SW4 may have a first end coupled to the first electrode of the sensing capacitor CS1 and a second end coupled to the second electrode of the sensing capacitor CS1.

The fifth switch SW5 may have a first end coupled to the output terminal of the amplifier AMP and a second end coupled to a fourth node N4.

The sixth switch SW6 may have a first end coupled to the fourth node N4 and a second end coupled to the first electrode of the sampling capacitor CS2.

The seventh switch SW7 may have a first end coupled to the first electrode of the sampling capacitor CS2 and a second end coupled to an analog-to-digital converter (ADC).

The first switch SW1 may have a first end coupled to the third node N3 and a second end coupled to the fourth node N4.

The sensor 15 may include the sensing channel 151 and the ADC. For example, the sensor 15 may include a number of ADCs corresponding to the number of sensing channels.

In other embodiments, the sensor 15 may include a single ADC, and may store sampling signals in the sensing channels, and convert the sampling signals by time-division.

Referring back to FIG. 2, the sensing line Ik is coupled to the initialization power source VINT during the display period. During the display period, the second switch SW2 may be in a turn-on state.

During the display period, the first switch SW1 and the third switch SW3 may be in a turn-off state. Therefore, the sensing line Ik may be prevented from being coupled to the reference power source VREF.

During the display period, data voltages DS(i−1)j, DSij, and DS(i+1)j may be sequentially applied to the data line Dj. A scan signal having a turn-on level (i.e., a high level) may be applied to the first scan line S1*i* during the period in which the data voltage DSij is applied to the data line Dj. In addition, a scan signal having a turn-on level may also be applied to the second scan line S2*i* in synchronization with the scan signal applied to the first scan line S1*i*. In an embodiment, during the display period, a scan signal having a turn-on level may always be applied to the second scan line S2*i*.

For example, when scan signals having a turn-on level are applied to the first scan line S1*i* and the second scan line S2*i*, the second transistor T2 and the third transistor T3 may be turned on. Therefore, a voltage corresponding to the difference between the data voltage DSij and the voltage of the initialization power source VINT may be stored in the storage capacitor Cst of the pixel PXij.

In the pixel PXij, an amount of driving current that flows through a driving path from the first power source ELVDD to the second power source ELVSS via the first transistor T1 may be determined depending on the voltage difference between the gate electrode and the source electrode of the first transistor T1. The luminance of light emitted by the light-emitting diode LD may be determined depending on the amount of driving current flowing through the driving path.

Thereafter, when scan signals having a turn-off level (i.e., a low level) are applied to the first scan line S1*i* and the second scan line S2*i*, the second transistor T2 and the third transistor T3 may be turned off. In this case, regardless of a change in the voltage of the data line Dj, the storage capacitor Cst may maintain the voltage difference between the gate electrode and the source electrode of the first transistor T1, thereby maintaining the luminance of light emitted by the light-emitting diode LD during the display period.

Figure 4:
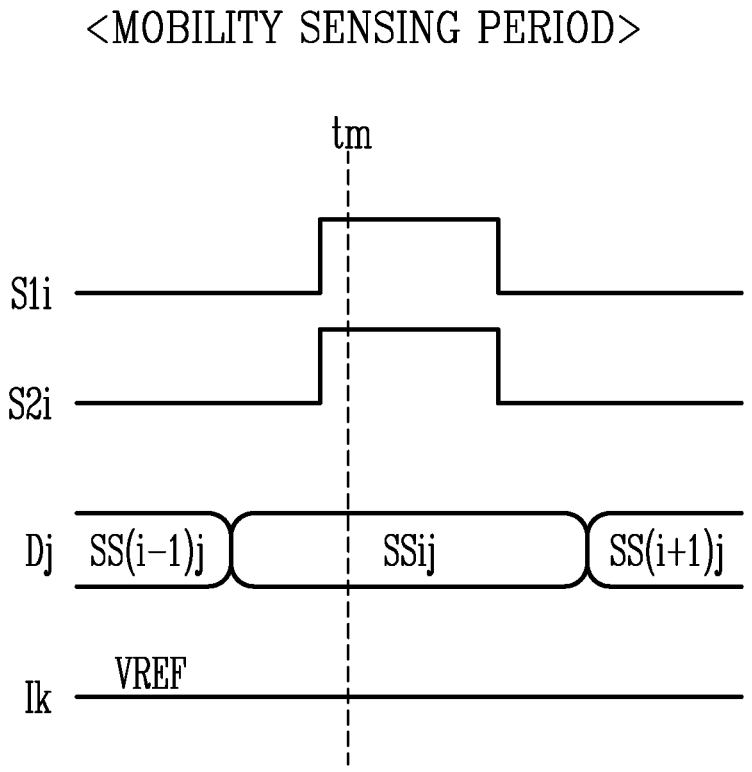
FIG. 4 and FIG. 5 are diagrams for explaining a mobility sensing period of a driving transistor according to an embodiment of the present disclosure.
Figure 5:
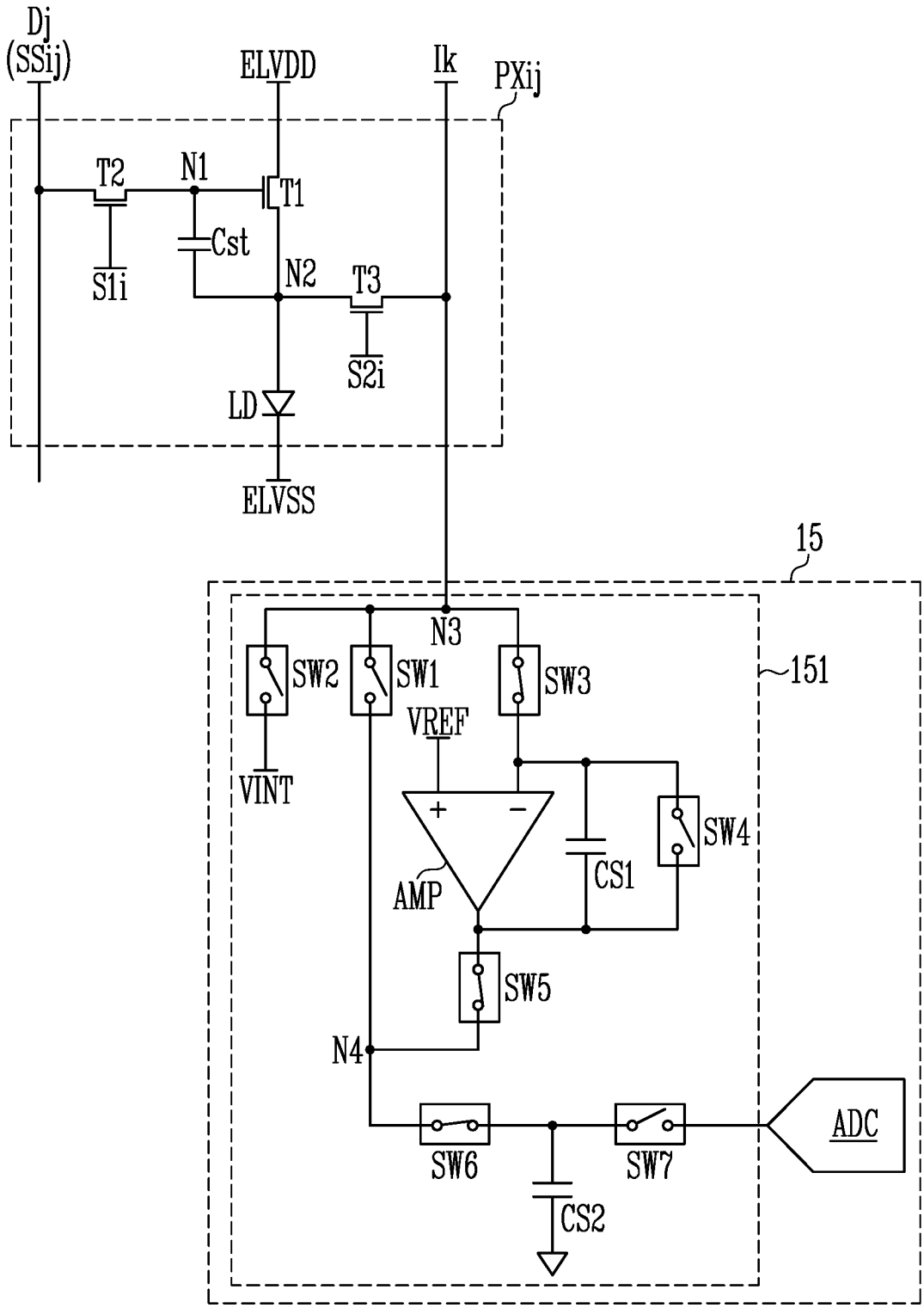

FIGS. 4 and 5 are diagrams for explaining a mobility sensing period of the driving transistor or the first transistor T1 according to an embodiment of the present disclosure.

FIG. 4 illustrates exemplary waveforms of signals that are applied to the first scan line S1*i*, the second scan line S2*i*, the data line Dj, and the sensing line I1*c* coupled to the pixel PXij during a mobility sensing period. FIG. 5 illustrates the states of the pixel PXij and the sensing channel 151 at a time point tm shown in FIG. 4.

During the mobility sensing period, sensing voltages SS(i−1), SSij, and SS(i+2)j may be sequentially applied to the data line Dj. In an embodiment, when only a single pixel row (i.e., pixels coupled to the same scan line) is sensed during the mobility sensing period, only the sensing voltage SSij may be applied to the data line Dj, and the sensing voltages SS(i−1)j and SS(i+1)j may not be applied to the data line Dj.

The sensing line I1*c* may be coupled to the reference power source VREF. Referring to FIG. 5, the third switch SW3 may be in a turn-on state. Since a non-inverting terminal and an inverting terminal of an amplifier AMP may be in a virtual short state, the sensing line I1*c* may be indicated as being coupled to the reference power source VREF.

When scan signals having a turn-on level are applied to the first scan line S1*i* and the second scan line S2*i* in synchronization with the sensing voltage SSij, the second transistor T2 and the third transistor T3 may be turned on.

Therefore, the sensing voltage SSij may be applied to the first node N1 of the pixel PXij, and the voltage of the reference power source VREF may be applied to the second node N2. The difference between the sensing voltage SSij and the voltage of the reference power source VREF may be higher than a threshold voltage of the first transistor T1. In this case, the first transistor T1 may be turned on, and a sensing current may flow through a sensing current path from the first power source ELVDD to the first electrode of the sensing transistor CS1 via the first transistor T1, the second node N2, the third transistor T3, the third node N3, and the third switch SW3. The sensing current may include the characteristic information of the first transistor T1 by the following Equation (1).

$$Id = \frac{1}{2}(u \times Co)\left(\frac{W}{L}\right)(Vgs - Vth)^2 \quad (1)$$

Here, Id denotes the sensing current flowing through the first transistor T1, u denotes mobility, Co denotes a capacitance formed through the sensing channel 151, one or more insulating layers, and the gate electrode of the first transistor T1, W denotes a channel width of the first transistor T1, L denotes the length of a channel of the first transistor T1, Vgs denotes a voltage difference between the gate electrode and the source electrode of the first transistor T1, and Vth denotes the threshold voltage of the first transistor T1.

Here, Co, W, and L may be fixed constants. Vth may be detected using an additional detection scheme (e.g., see FIGS. 6 and 7), which will be discussed in further detail below. Vgs may be the voltage difference between the sensing voltage SSij and the voltage of the reference power source VREF. Since the voltage of the third node N3 is fixed, the voltage of the fourth node N4 becomes lower as the sensing current Id becomes larger. The voltage of the fourth node N4 may be stored, as a sampling signal, in the sampling capacitor CS2. The ADC may calculate the magnitude of the sensing current Id by converting the sampling signal stored in the sampling capacitor CS2 into a digital signal through the turned-on seventh switch SW7. Therefore, the remaining variable, that is, the mobility u, may be obtained during the mobility sensing period of the driving transistor or the first transistor T1.

Figure 6:
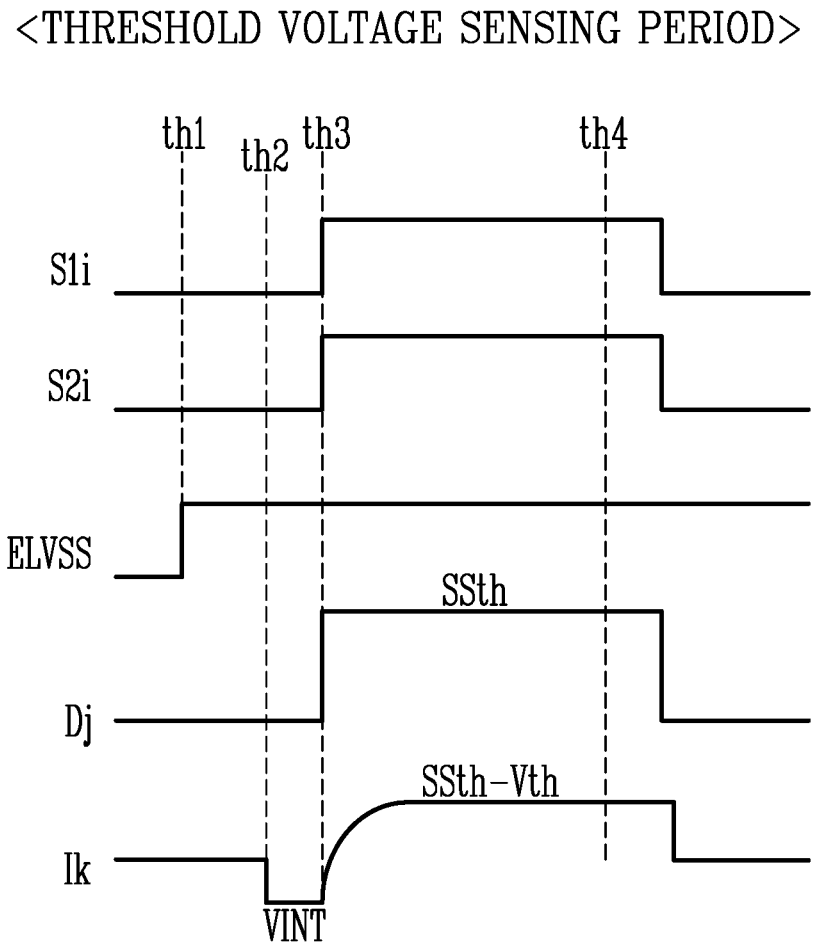
FIG. 6 and FIG. 7 are diagrams for explaining a threshold voltage sensing period of a driving transistor according to an embodiment of the present disclosure.
Figure 7:
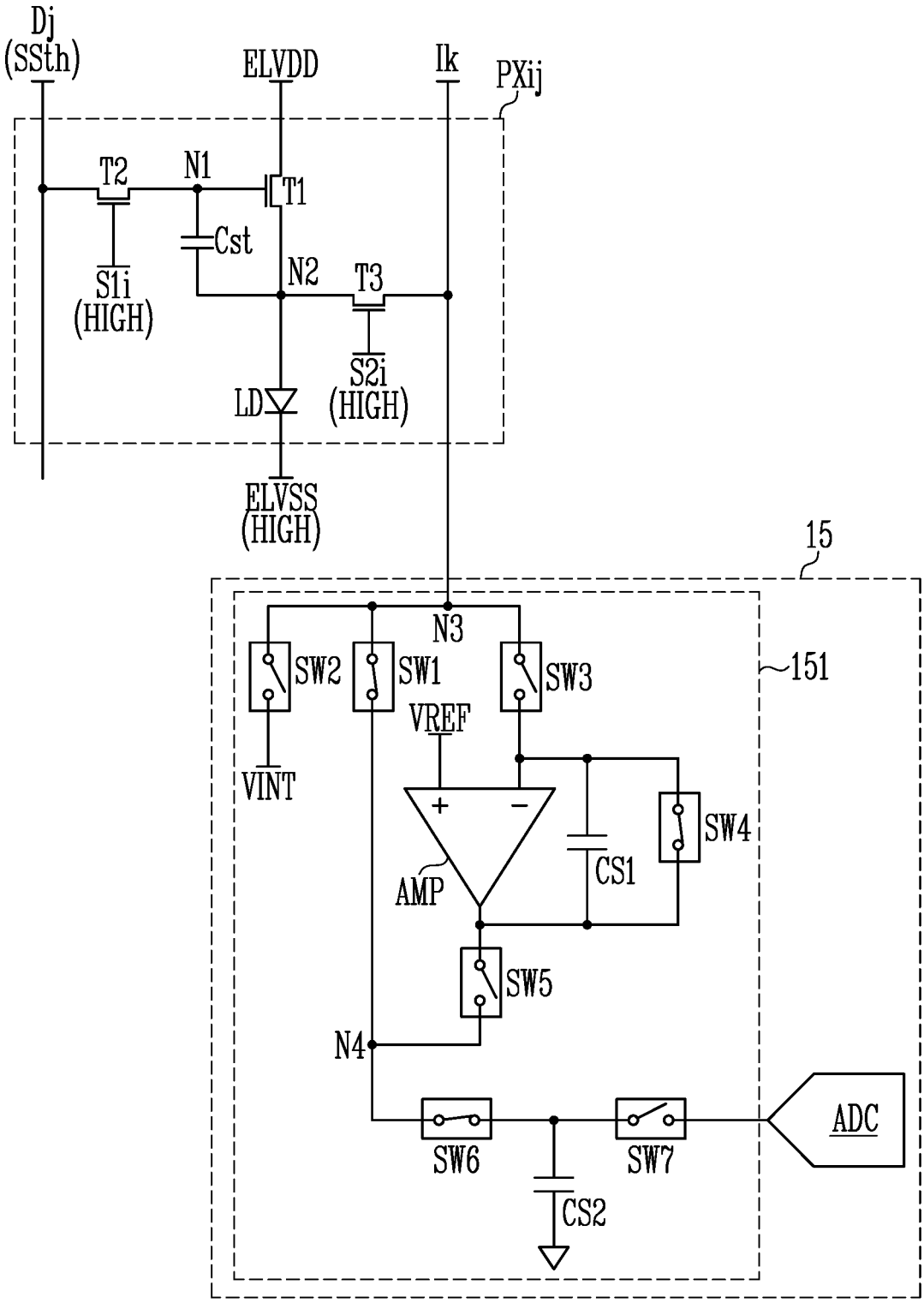

FIGS. 6 and 7 are diagrams for explaining a threshold voltage sensing period of the driving transistor or the first transistor T1 according to an embodiment of the present disclosure.

FIG. 7 illustrates the states of the pixel PXij and the sensing channel 151 at a time point th4 of FIG. 6. The third switch SW3 and the fifth switch SW5 may remain turned off, and the first switch SW1 may remain turned on.

Referring to FIG. 6, at a time point th1, the voltage of the second power source ELVSS rises, thus preventing light emission of the light-emitting diode LD.

Next, at a time point th2, the second switch SW2 is turned on, and thus the sensing line I1*c* may be initialized to the voltage of the initialization power source VINT.

Next, at a time point th3, scan signals having a turn-on level may be applied to the first scan line S1*i* and the second scan line S2*i*. At this time, a sensing voltage SSth may be applied to the data line Dj. Therefore, the first node N1 may be maintained at the sensing voltage SSth. In addition, the sensing line I1*c* may be coupled to the second node N2.

The second node N2 may rise from the voltage of the initialization power source VINT to a voltage SSth-Vth. When the voltage of the second node N2 reaches the voltage SSth-Vth, the first transistor T1 may be turned off, and thus the voltage of the second node N2 stops rising further.

The sixth switch SW6 may be in a turn-on state, and thus a sampling signal may be stored in the sampling capacitor CS2. Here, since the fourth node N4 is coupled to the second node N2, the sampling signal may include the threshold voltage Vth of the first transistor T1. The seventh switch SW7 is turned on, and thus the ADC may convert the sampling signal into a digital signal during the threshold voltage sensing period of the driving transistor or the first transistor T1.

Figure 8:
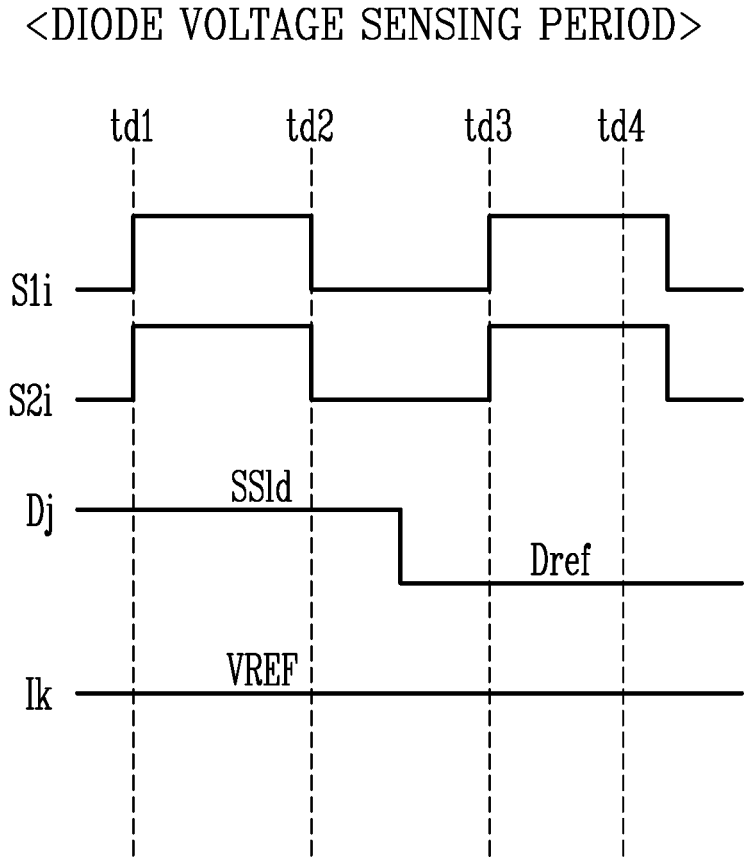
FIG. 8 and FIG. 9 are diagrams for explaining a threshold voltage sensing period of a light-emitting diode according to an embodiment of the present disclosure.
Figure 9:
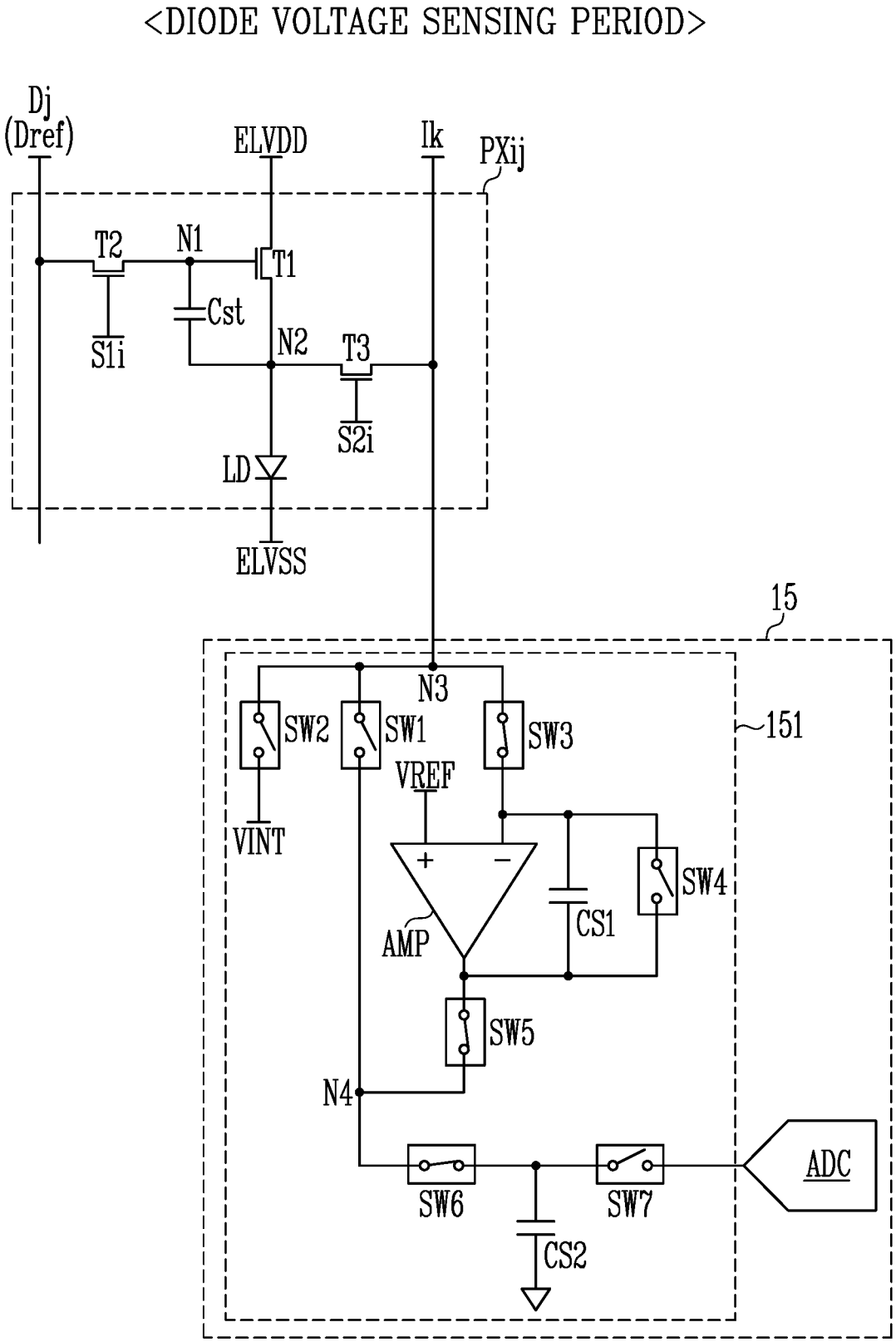

FIGS. 8 and 9 are diagrams for explaining a threshold voltage sensing period of the light-emitting diode LD according to an embodiment of the present disclosure. FIG. 9 illustrates the states of the pixel PXij and the sensing channel 151 at a time point td4 of FIG. 8.

At a time point td1, a sensing voltage SSId may be applied to the data line Dj. The voltage of the reference power source VREF may be applied to the sensing line I1*c* through the third switch SW3. Here, scan signals having a turn-on level may be applied to the first scan line S1*i* and the second scan line S2*i*, and transistors T2 and T3 may be turned on. Accordingly, the storage capacitor Cst may store the difference between the sensing voltage SSId and the voltage of the reference power source VREF.

At a time point td2, scan signals having a turn-off level may be applied to the first scan line S1*i* and the second scan line S2*i*. Since the first transistor T1 may remain turned on due to voltage stored in the storage capacitor Cst, the voltage of the second node N2 may rise in accordance with a degree of degradation of the light-emitting diode LD. For example, as the degree of degradation of the light-emitting diode LD becomes more serious, the voltage of the second node N2 may rise more highly. The voltage converging on the second node N2 may correspond to the threshold voltage of the light-emitting diode LD.

At a time point td3, scan signals having a turn-on level may be applied to the first scan line S1*i* and the second scan line S2*i*. At this time, a data reference voltage Dref may be applied to the data line Dj. The data reference voltage Dref may be a voltage having a turn-off level. Therefore, in a state in which the first transistor T1 remains turned off, the voltage of the second node N2 may be stably sensed by the sensing channel 151. While the sensing channel 151 is sensing the voltage of the second node N2, the fourth switch SW4 may be in a turn-off state.

Since the third switch SW3 is in a turn-on state and the voltage of the third node N3 is fixed at the voltage of the reference power source VREF, the voltage of the fourth node N4 may decrease as the magnitude of the voltage of the second node N2 becomes larger (i.e., as the amount of charges to be supplied becomes larger). The voltage of the fourth node N4 may be stored in the sampling capacitor CS2, and the ADC may convert the voltage into a digital value. Accordingly, characteristic information corresponding to the threshold voltage of the light-emitting diode LD may be sensed during the threshold voltage sensing period of the light-emitting diode LD.

Figure 10:
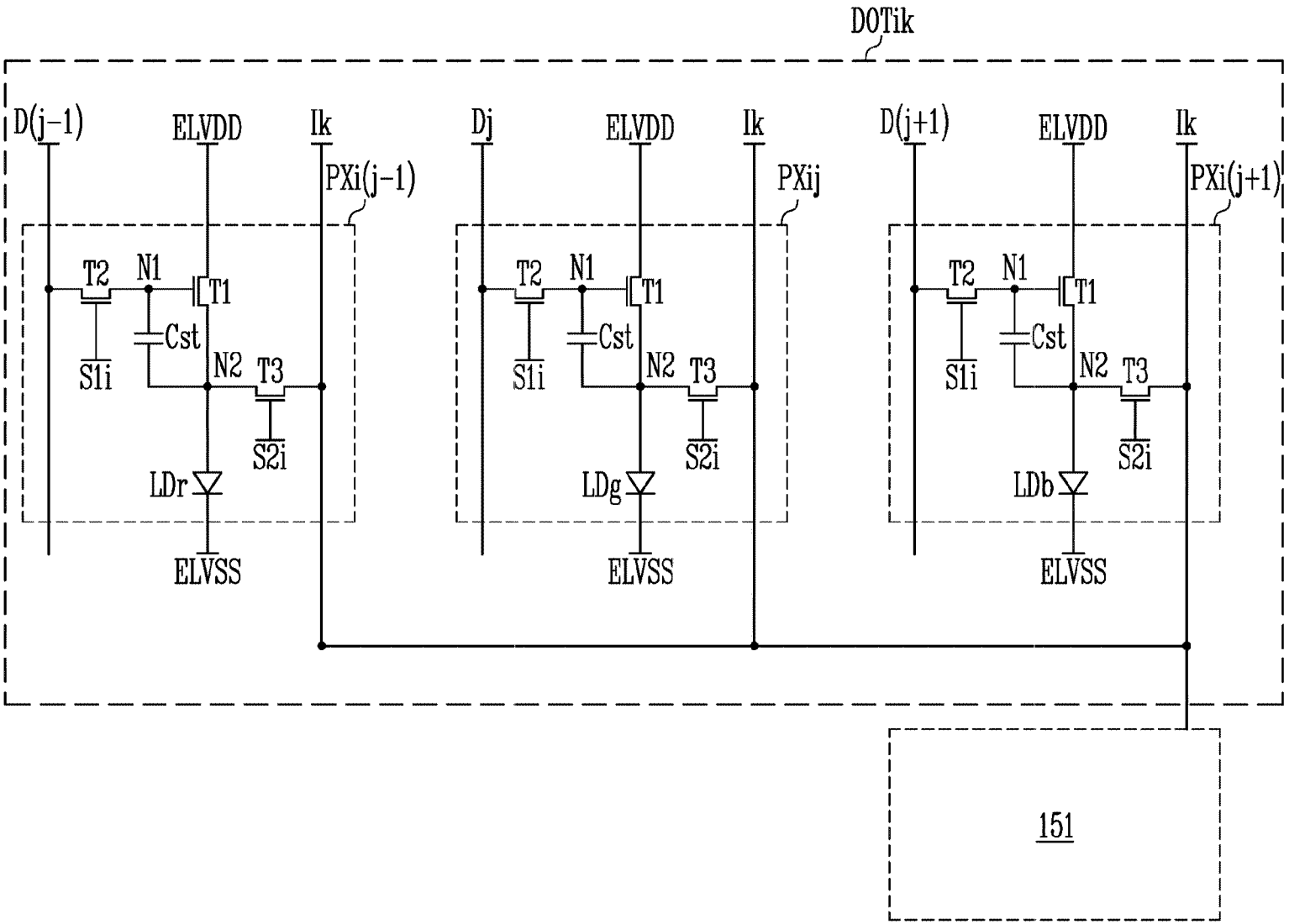
FIG. 10 is a diagram illustrating a dot according to an embodiment of the present disclosure.

FIG. 10 is a diagram illustrating a dot according to an embodiment of the present disclosure.

Referring to FIG. 10, a dot DOTik may include a plurality of pixels PXi(j−1), PXij, and PXi(j+1). The plurality of pixels PXi(j−1), PXij, and PXi(j+1) included in the same dot DOTik may be commonly coupled to the sensing channel 151 through the same sensing line Ik.

For example, the plurality of pixels PXi(j−1), PXij, and PXi(j+1) may correspond to pixels of different colors. For example, the pixel PXi(j−1) may be a pixel of a first color, the pixel PXij may be a pixel of a second color, and the pixel PXi(j+1) may be a pixel of a third color. That is, the pixel PXi(j−1) may include a light-emitting diode LDr that is capable of emitting light of a first color, the pixel PXij may include a light-emitting diode LDg that is capable of emitting light of a second color, and the pixel PXi(j+1) may include a light-emitting diode LDb that is capable of emitting light of a third color.

The first color, the second color, and the third color may be different colors from each other. In one embodiment, the first color may be one of red, green, and blue, the second color may be one of red, green, and blue, other than the first color, and the third color may be the remaining one of red, green, and blue, other than the first color and the second color. In another embodiment, magenta, cyan, and yellow may be used as the first to third colors instead of red, green, and blue.

In accordance with an embodiment, the sensor 15 may sense pixels of the same color when sensing the characteristic information of the pixels in the pixel component 14. The sensing controller 16 may interpolate data for the pixels of the same color. For example, during a first color sensing period, the sensor 15 may sense characteristic information from the pixels of the first color in the pixel component 14, and the sensing controller 16 may interpolate the sensed characteristic information for the pixels of the first color. Similarly, during a second color sensing period differing from the first color sensing period, the sensor 15 may sense characteristic information from the pixels of the second color, and the sensing controller 16 may interpolate the sensed characteristic information for the pixels of the second color. Further, during a third color sensing period differing from the first color sensing period and the second color sensing period, the sensor 15 may sense characteristic information from the pixels of the third color, and the sensing controller 16 may interpolate the sensed characteristic information for the pixels of the third color.

For example, while the pixel PXi(j−1) of the first color is sensed, data voltages having a turn-off level may be applied to data lines Dj and D(j+1) of the pixel PXij of the second color and the pixel PXi(j+1) of the third color. Therefore, while the pixel PXi(j−1) of the first color is sensed, the first transistors T1 of the pixels PXij and PXi(j+1) are turned off, thus preventing the pixels PXij and PXi(j+1) from influencing the characteristic information of the pixel PXi(j−1).

It is noted that FIG. 10 illustrates an example in which each dot has an RGB stripe structure as a non-limiting example, and the three pixels PXi(j−1), PXij, and PXi(j+1) are illustrated as being equally coupled to the scan lines S1*i* and S2*i*. In another embodiment, when each dot is configured in a pentile structure, the dot may include only two pixels. Respective dots may be coupled to different scan lines, and may include pixels of different colors that share the same sensing line.

Figure 11:
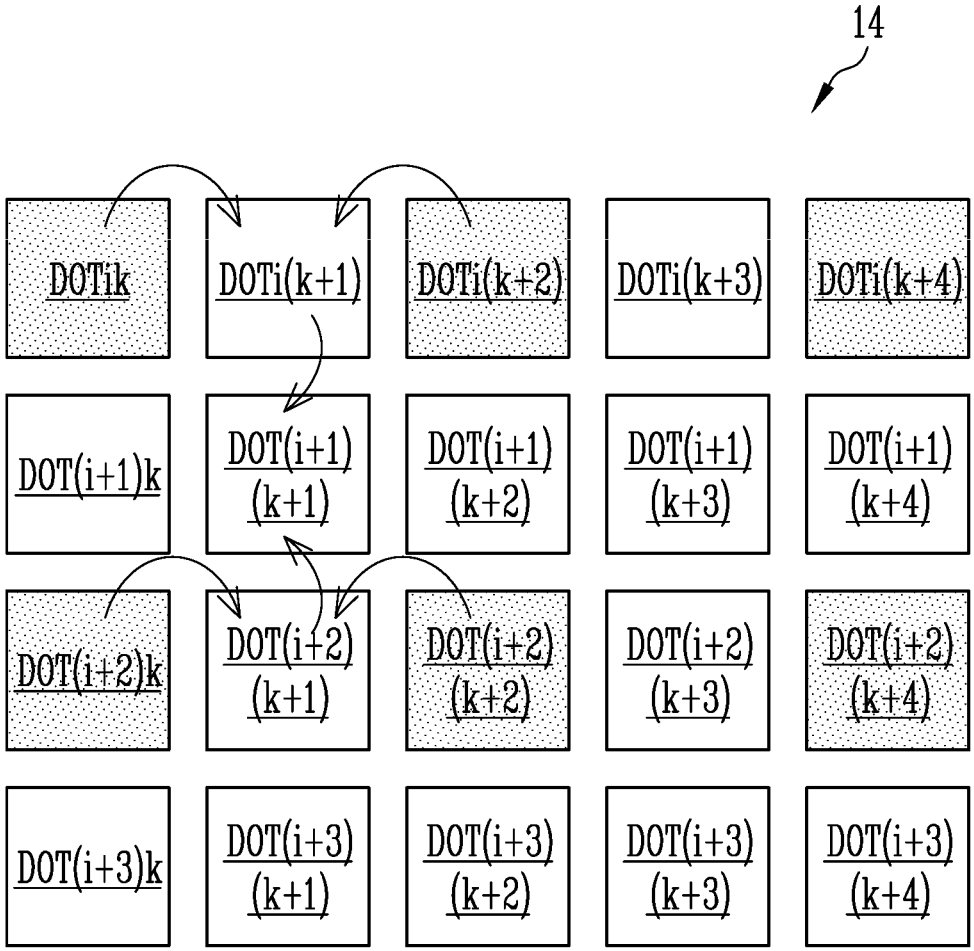
FIG. 11 is a diagram illustrating an interpolation scheme according to an embodiment of the present disclosure.

FIG. 11 is a diagram illustrating an interpolation scheme according to an embodiment of the present disclosure.

In FIG. 11 and subsequent drawings, whether sensing/non-sensing is to be performed is illustrated on the basis of a dot for the purpose of convenient description with respect to FIG. 10. As described above, during a sensing period of a dot, one pixel of the dot is sensed depending on a color sensing period, and all pixels included in the dot may not be simultaneously sensed. For example, during a first color sensing period, a first pixel of a first color in the dot is sensed. Therefore, during each color sensing period, each dot may be specified as a specific pixel. For convenience of description, in the subsequent embodiments, it is assumed that sensing and interpolation are performed during the first color sensing period. Therefore, each dot may be specified as a first pixel, and the term "dot" and the term "first pixel" may be used interchangeably with each other.

FIG. 11 illustrates an exemplary case where, during a first period, dots DOTik, DOTi(k+2), DOTi(k+4), DOT(i+2)k, DOT(i+2)(k+2), and DOT(i+2)(k+4) of the pixel component 14 are sensed, and dots DOTi(k+1), DOTi(k+3), DOT(i+1)k, DOT(i+1)(k+1), DOT(i+1)(k+2), DOT(i+1)(k+3), DOT(i+1)(k+4), DOT(i+2)(k+1), DOT(i+2)(k+3), DOT(i+3)k, DOT(i+3)(k+1), DOT(i+3)(k+2), DOT(i+3)(k+3), and DOT(i+3)(k+4) are not sensed. That is, among odd-numbered pixel rows, odd-numbered first pixels are sensed and even-numbered first pixels are not sensed, and none of the even-numbered pixel rows are sensed. Whether the pixel to be sensed is an odd-numbered pixel or an even-numbered pixel may be set differently according to the embodiment.

In FIG. 11, each arrow pointing from a dot to another dot indicates that the dot from the arrow points has data that is the basis of interpolation, and the data to which the arrow points has the calculated interpolated data. This will be described in detail later with reference to FIG. 13.

Figure 12:
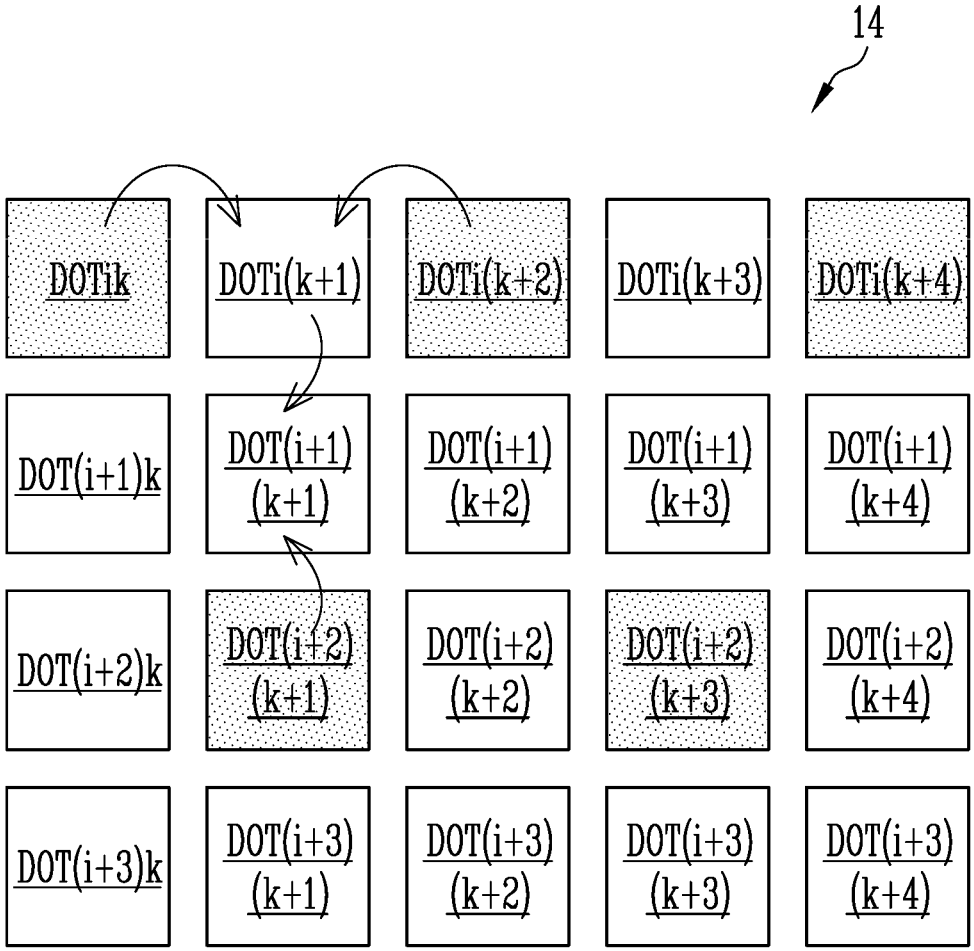
FIG. 12 is a diagram illustrating an interpolation scheme according to an embodiment of the present disclosure.

FIG. 12 is a diagram illustrating an interpolation scheme according to an embodiment of the present disclosure.

FIG. 12 illustrates a first period in an embodiment that differs from that of FIG. 11.

FIG. 12 illustrates an exemplary case where, during the first period, dots DOTik, DOTi(k+2), DOTi(k+4), DOT(i+2)(k+1), and DOT(i+2)(k+3) of the pixel component 14 are sensed, and dots DOTi(k+1), DOTi(k+3), DOT(i+1)k, DOT(i+1)(k+1), DOT(i+1)(k+2), DOT(i+1)(k+3), DOT(i+1)(k+4), DOT(i+2)k, DOT(i+2)(k+2), DOT(i+2)(k+4), DOT(i+3)k, DOT(i+3)(k+1), DOT(i+3)(k+2), DOT(i+3)(k+3), and DOT(i+3)(k+4) are not sensed. That is, the embodiment of FIG. 12 is the same as that of FIG. 11 in that none of the even-numbered pixel rows are sensed, but is different from that of FIG. 11 in that, as first pixels sensed in odd-numbered pixel rows, odd-numbered first pixels and even-numbered first pixels are alternately sensed.

Figure 13:
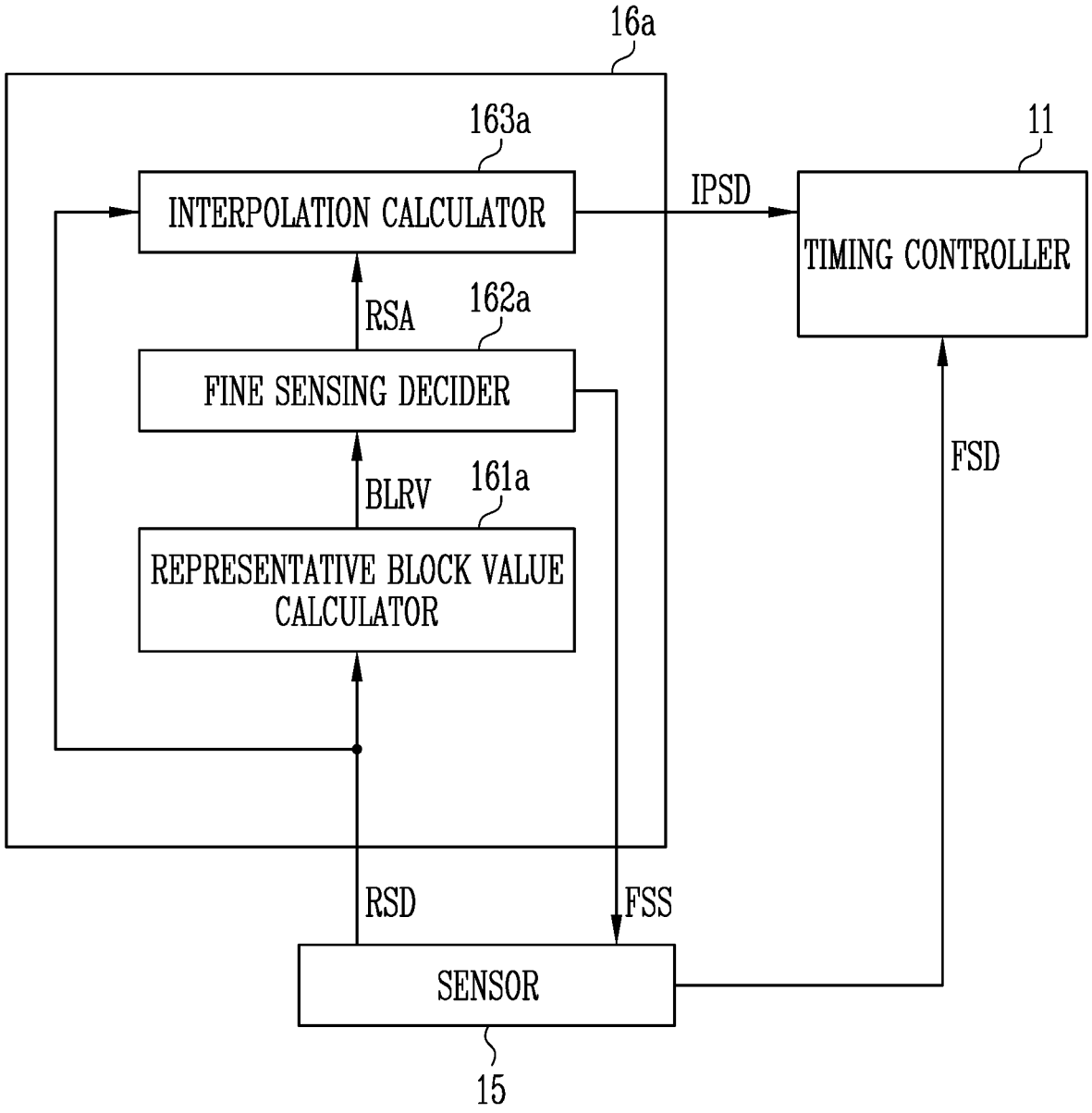
FIG. 13, FIG. 14, and FIG. 15 are diagrams illustrating a sensing controller according to an embodiment of the present disclosure.
Figure 14:
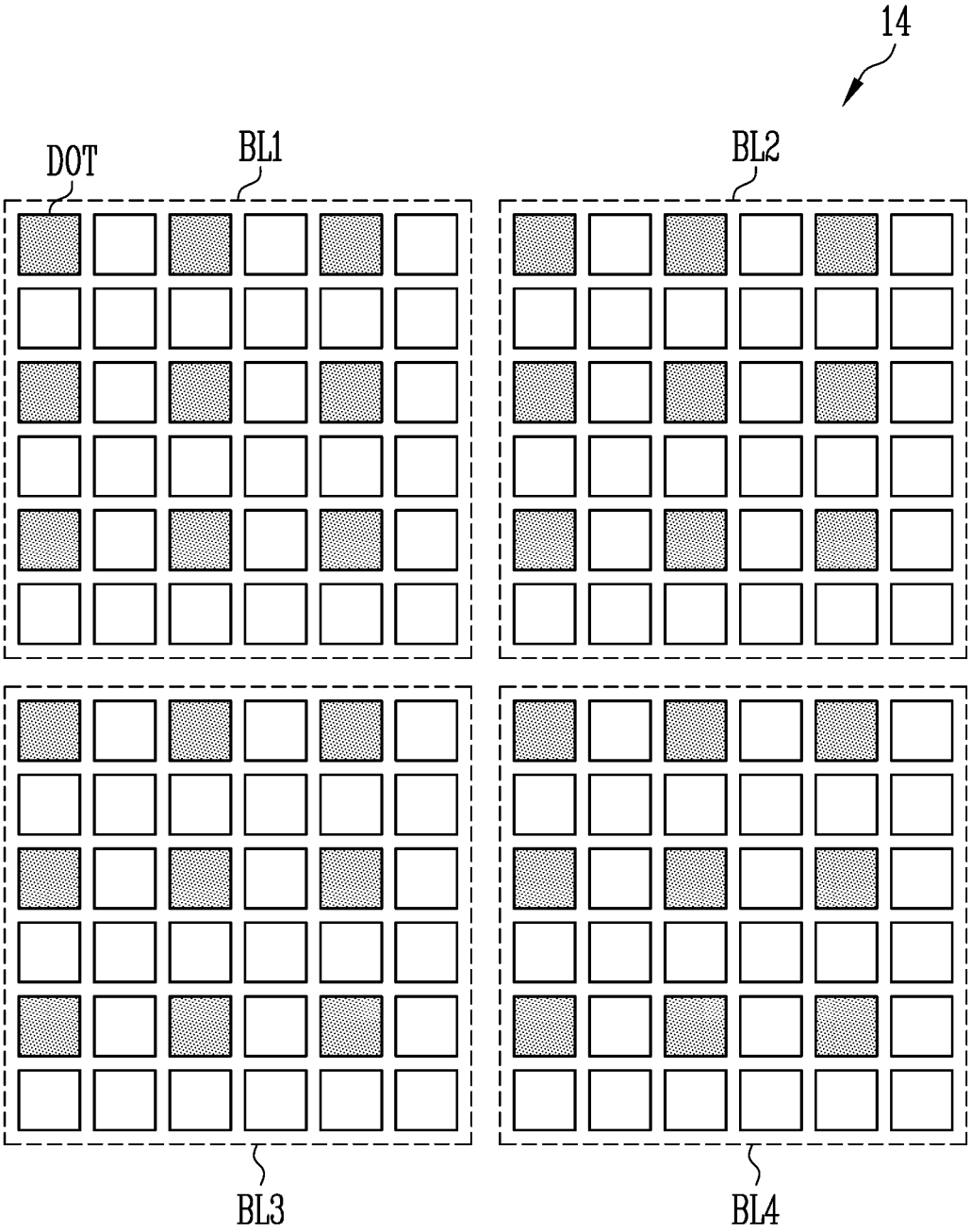
Figure 15:
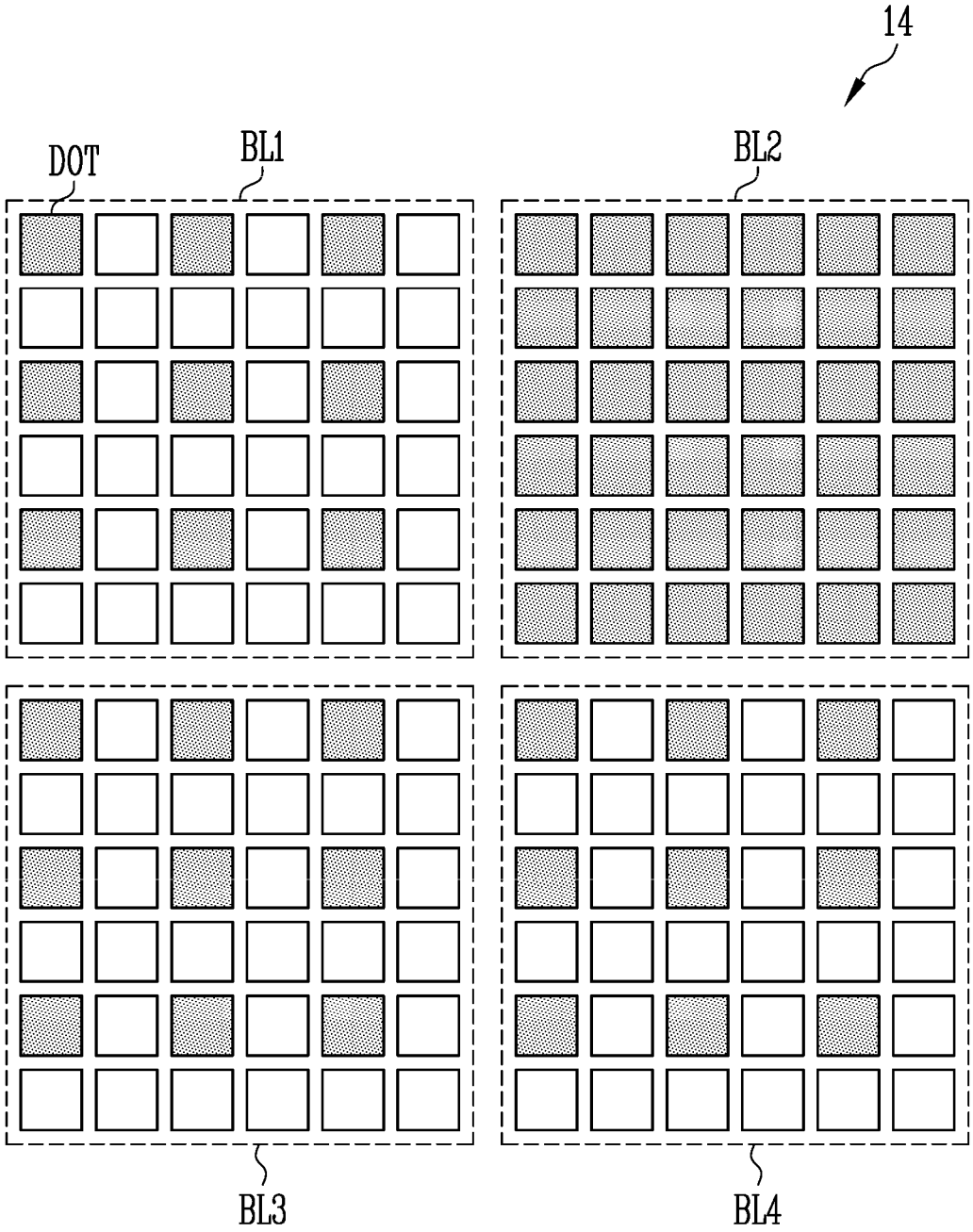

FIGS. 13 to 15 are diagrams illustrating a sensing controller according to an embodiment of the present disclosure.

Referring to FIG. 13, a sensing controller 16*a* may include a representative block value calculator 161*a*, a fine sensing decider 162*a*, and an interpolation calculator 163*a*.

Referring to FIG. 14, the pixel component 14 may include first pixels partitioned into a plurality of blocks BL1, BL2, BL3, and BL4. Each of the blocks BL1 to BL4 may include at least three first pixels.

The sensor 15 may generate first sensing data RSD for at least two first pixels in each of the blocks BL1 to BL4 during a first period. FIG. 14 illustrates a state in which first sensing data RSD are sensed (i.e., a dotted pattern) during the first period based on the interpolation scheme of FIG. 11.

The sensing controller 16*a* may generate interpolated data IPSD for the first pixels that are not sensed by interpolating the first sensing data RSD for a first block, among the blocks BL1 to BL4, and may not interpolate the first sensing data RSD for a second block, among the blocks BL1 to BL4.

The representative block value calculator 161*a* may calculate a representative block value BLRV of first sensing data for each of the blocks BL1 to BL4. The representative block value BLRV may be at least one of a standard deviation value, an average value, the maximum value, and the minimum value of the first sensing data RSD, for each of the blocks BL1 to BL4. Hereinafter, for convenience of description, a case in which the standard deviation value of the first sensing data RSD is used as the representative block value BLRV will be described.

The fine sensing decider 162*a* may categorize or decide each of the blocks BL1 to BL4 as one of the first block and the second block using the representative block value BLRV. For example, the fine sensing decider 162*a* may decide the block BL2, the standard deviation value of which is greater than a block threshold value, as the second block, and may decide the blocks BL1, BL3, and BL4, the standard deviation values of which are less than or equal to the block threshold value, as the first block. That is, the fine sensing decider 162*a* may determine that the block BL2 including the first sensing data RSD having a greater deviation is unsuitable for interpolation and that the blocks BL1, BL3, and BL4 including the first sensing data RSD having a less deviation are suitable for interpolation.

Accordingly, the fine sensing decider 162*a* may transmit a rough sensing allowance signal RSA to the interpolation calculator 163*a* for interpolating data corresponding to the blocks BL1, BL3, and BL4, among the first sensing data RSD. In addition, the fine sensing decider 162*a* may transmit a fine sensing signal FSS to the sensor 15 so that the sensor 15 senses fine sensing on the block BL2, among the first sensing data RSD.

The interpolation calculator 163*a* may generate the interpolated data IPSD by interpolating the first sensing data RSD for the blocks BL1, BL3 and BL4 designated as the first block. Therefore, since there is no need to sense all pixels of the blocks BL1, BL3, and BL4, sensing time may be saved.

In accordance with an embodiment, the interpolation calculator 163*a* may generate first interpolated data, among the interpolated data IPSD, using the first sensing data RSD, and may generate second interpolated data, among the interpolated data IPSD, using the first interpolated data. Referring to FIG. 11, first interpolated data for the dot DOTi(k+1) that is interposed between the adjacent dots DOTik and DOTi(k+2) may be generated using first sensing data RSD of the adjacent dots DOTik and DOTi(k+2). In addition, first interpolated data for the dot DOT(i+2)(k+1) that is interposed between the adjacent dots DOT(i+2)k and DOT(i+2)(k+2) may be generated using first sensing data RSD of the adjacent dots DOT(i+2)k and DOT(i+2)(k+2). Next, second interpolated data for the dot DOT(i+1)(k+1) that is interposed between the adjacent dots DOTi(k+1) and DOT(i+2)(k+1) may be generated using the first interpolated data for the adjacent dots DOTi(k+1) and DOT(i+2)(k+1).

In accordance with an embodiment, the interpolation calculator 163*a* may generate first interpolated data, among the interpolated data, using the first sensing data RSD, and may generate second interpolated data using the first interpolated data and the first sensing data RSD. Referring to FIG. 12, first interpolated data for the dot DOTi(k+1) that is interposed between the adjacent dots DOTik and DOTi(k+2) may be generated using first sensing data RSD of the adjacent dots DOTik and DOTi(k+2). Next, second interpolated data for the dot DOT(i+1)(k+1) that is interposed between the adjacent dots DOTi(k+1) and DOT(i+2)(k+1) may be generated using the first interpolated data for the dot DOTi(k+1) and the first sensing data RSD of the dot DOT(i+2)(k+1).

Referring to FIG. 15, the sensor 15 may generate second sensing data FSD for the first pixels that are not sensed for the block BL2 that is designated as the second block during a second period after the first period. Therefore, since data directly sensed from all of the first pixels in the block BL2 is used, errors may not occur in the characteristic information of the first pixels in the block BL2.

The timing controller 11 may generate grayscale values for the first pixels using the interpolated data IPSD and the second sensing data FSD. As described above with reference to FIG. 1, the timing controller 11 may receive the grayscale values for respective image frames from an external processor. The timing controller 11 may convert the received grayscale values depending on the characteristic information of the first pixels by incorporating the current physical states of the pixel component 14 (e.g., a process deviation, a degree of degradation, etc.) into the converted grayscale values. Therefore, the display device 10 may prevent a problem such as the indication of stain.

Figure 16:
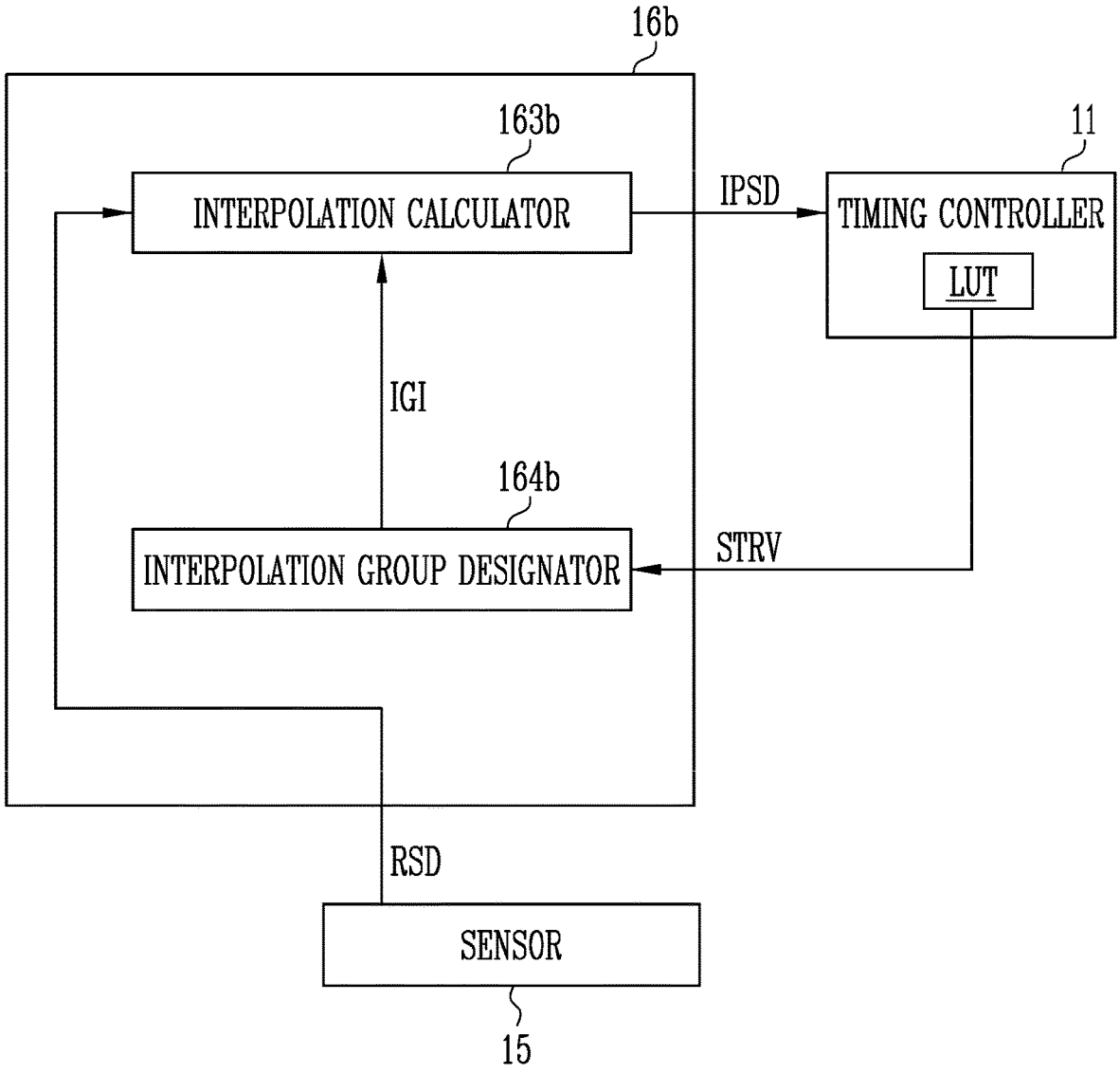
FIG. 16, FIG. 17, and FIG. 18 are diagrams illustrating a sensing controller according to an embodiment of the present disclosure.
Figure 17:
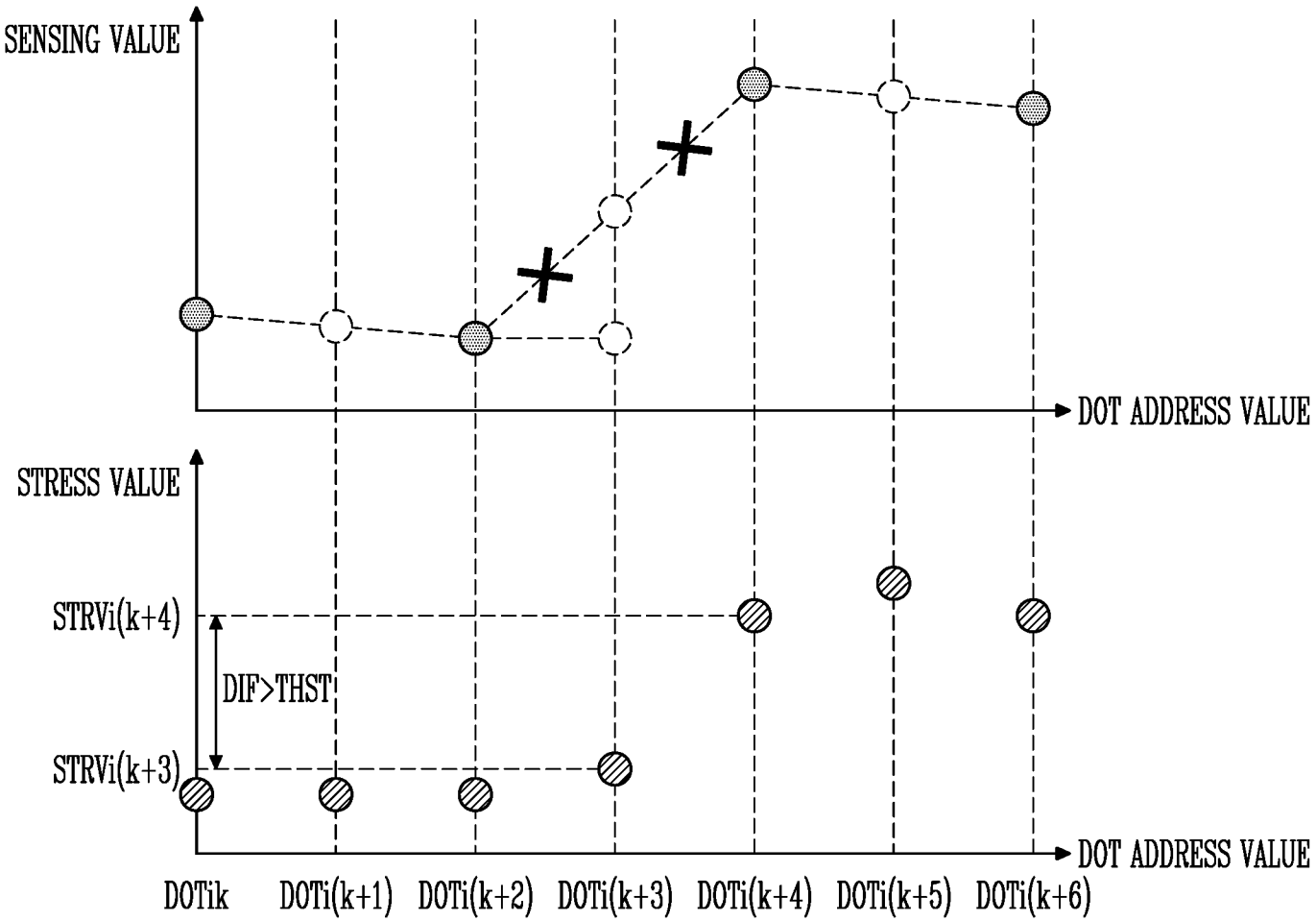
Figure 18:
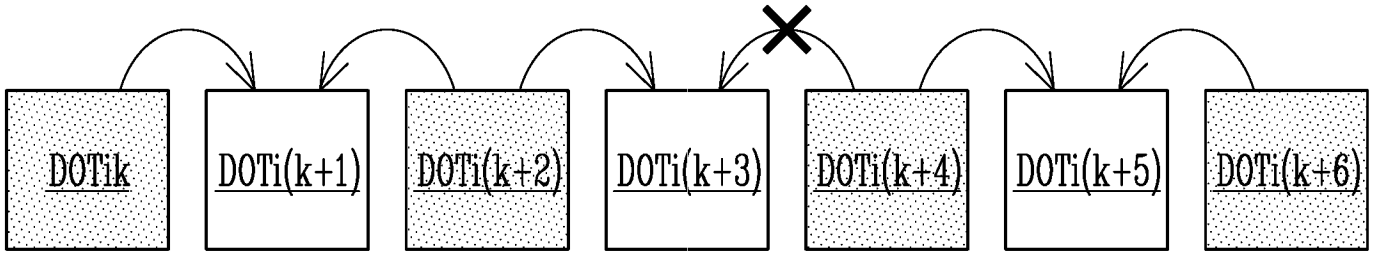

FIGS. 16 to 18 are diagrams illustrating a sensing controller according to an embodiment of the present disclosure.

Referring to FIG. 16, a sensing controller 16*b* may include an interpolation group designator 164*b* and an interpolation calculator 163*b*.

The timing controller 11 may include a lookup table LUT. The lookup table LUT may be present in a data form or in a physical form, such as a memory. In one embodiment, the lookup table LUT may be located outside the timing controller 11.

The lookup table LUT may include stress values STRV for first pixels. The stress values STRV may accumulate to a current time point rather than values at a specific time point. As such, a larger stress value may be accumulated as the amount of current flowing through each first pixel is larger, as the ambient temperature of the first pixel is higher, and/or as a gray scale represented by the first pixel is a higher grayscale level. In other embodiments, factors other than current, temperature, and grayscale may contribute to the stress value of the first pixels. The stress values STRV may be different from sensing data in that the stress values STRV are accumulated information of external factors that may have accumulatively influenced the first pixels, rather than being obtained by instantaneously measuring the physical states of the first pixels.

The stress values STRV may correspond to specific elements of the first pixels. For example, the stress values STRV may be related to the light-emitting diode LD or the first transistor T1. The lookup table LUT may also include stress values for second pixels and third pixels.

The sensor 15 may generate the sensing data RSD for at least some of the first pixels.

The sensing controller 16*b* may generate the interpolated data IPSD for at least some of the first pixels that are not sensed by interpolating the sensing data RSD with reference to the stress values STRV.

The interpolation group designator 164*b* may designate adjacent first pixels having the stress values STRV, the difference between which is less than or equal to a stress threshold value, as the same interpolation group.

FIG. 17 illustrates exemplary stress values for respective dot address values in a graph on a lower side. The stress values may be digital values, and may be unitless values. For example, the difference DIF between a stress value STRVi (k+3) for a first pixel in a dot DOTi(k+3) and a stress value STRVi(k+4) for a first pixel in a dot DOTi(k+4) may be greater than a stress threshold value THST. For example, dots DOTi(k+4), DOTi(k+5), and DOTi(k+6) may correspond to a constant display area (e.g., an area in which information such as time, communication status, etc. is constantly displayed). For example, dots DOTik, DOTi(k+1), DOTi(k+2), and DOTi(k+3) may correspond to a normal display area (e.g., an area in which a varying image is displayed).

In the present example, the interpolation group designator 164*b* may designate the adjacent dots DOTik, DOTi(k+1), and DOTi(k+2) as a single interpolation group and designate the adjacent dots DOTi(k+4), DOTi(k+5), and DOTi(k+6) as an additional interpolation group. In contrast, the interpolation group designator 164*b* may not designate an interpolation group for the adjacent dots DOTi(k+2), DOTi(k+3), and DOTi(k+4).

The interpolation calculator 163*b* may generate the interpolated data IPSD for respective interpolation groups. Interpolation is performed on the dots DOTi(k+1) and DOTi(k+5), for which interpolation groups are designated, in a manner identical or similar to that described with reference to FIGS. 14 and 15, and the interpolated data IPSD may be generated accordingly. However, for the dot DOTi(k+3) for which an interpolation group is not designated, the sensing data of the dot DOTi(k+2) having a similar stress value between the dots DOTi(k+2) and DOTi(k+4) adjacent thereto may be copied, and the interpolated data IPSD may be generated accordingly. FIG. 18 illustrates an example in which the generation of the interpolated data IPSD that falls out of an error range for the dot DOTi(k+3) may be prevented.

Figure 19:
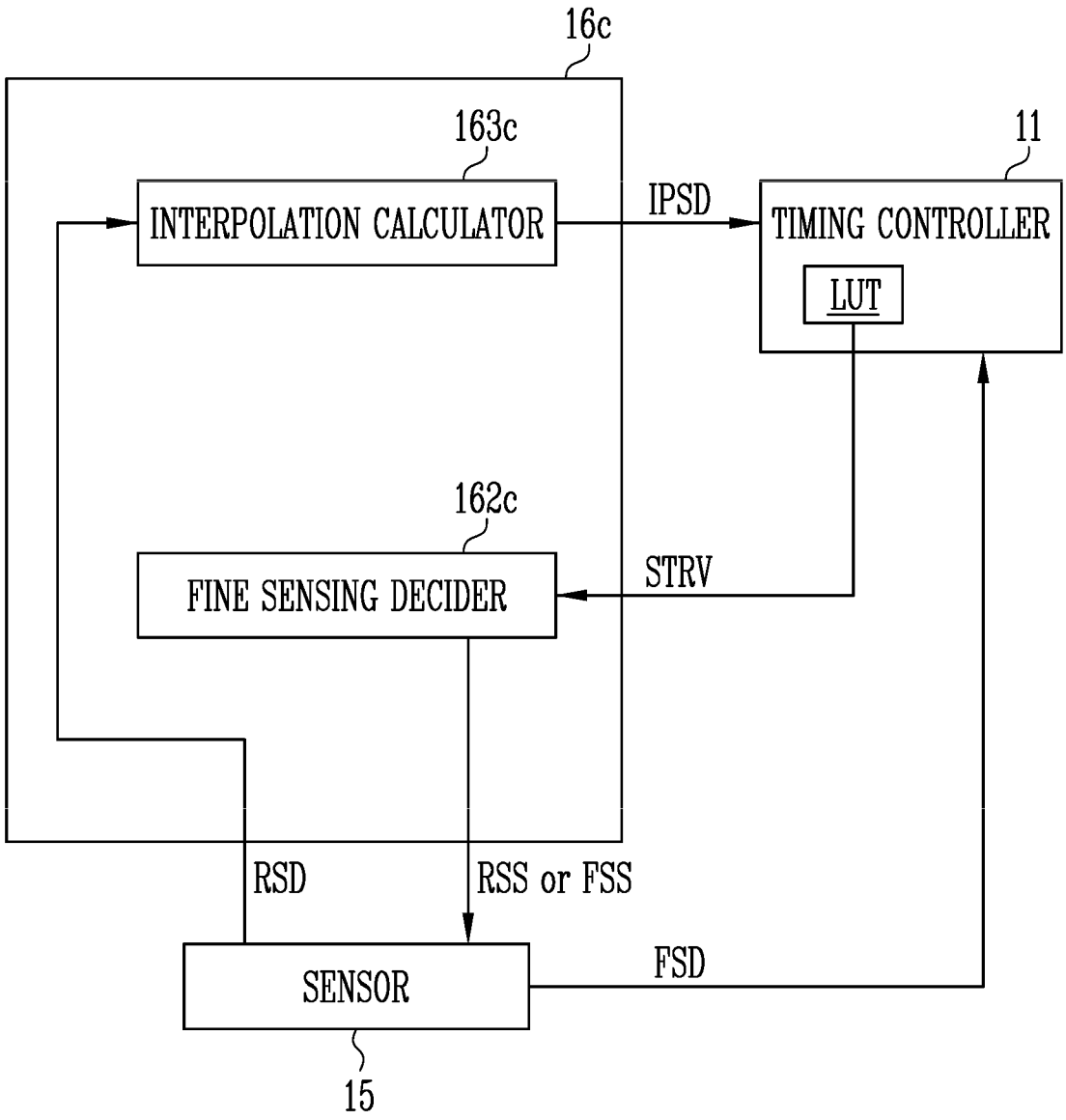
FIG. 19 is a diagram illustrating a sensing controller according to an embodiment of the present disclosure.

FIG. 19 is a diagram illustrating a sensing controller according to an embodiment of the present disclosure.

Referring to FIG. 19, a sensing controller 16*c*=may include a fine sensing decider 162*c* and an interpolation calculator 163*c*.

The timing controller 11 may include a lookup table LUT. The description of the lookup table LUT may be referred to the embodiment of FIG. 16.

The sensing controller 16*c* may generate the interpolated data IPSD for at least some of the first pixels that are not sensed by interpolating sensing data RSD with reference to the stress values STRV.

The fine sensing decider 162*c* may decide each of blocks as one of a first block and a second block using a representative stress value of the stress values STRV.

The representative stress value may be at least one of a standard deviation value, an average value, the maximum value, and the minimum value of stress values STRV for each block. Hereinafter, for convenience of description, a case in which the standard deviation value of the stress values STRV is used as the representative stress value will be described.

The fine sensing decider 162*c* may decide blocks, the standard deviation value of which is greater than the stress threshold value THST, as the second block, and may decide blocks, the standard deviation value of which is less than or equal to the stress threshold value THST, as the first block. The fine sensing decider 162*c* may transmit a rough sensing signal RSS so that only some pixels are sensed for the blocks designated as the first block, and may transmit a fine sensing signal FSS so that all pixels are sensed for the blocks designated as the second block.

The sensor 15 may generate first sensing data RSD and second sensing data FSD for at least some of first pixels. The sensor 15 may generate the first sensing data RSD for at least two first pixels that belong to the first block, and may generate the second sensing data FSD for all of first pixels that belong to the second block. For example, the sensor 15 may transmit the first sensing data RSD, obtained by sensing only some pixels of the blocks designated as the first block in response to the rough sensing signal RSS, to the interpolation calculator 163*c*. In addition, the sensor 15 may transmit the second sensing data FSD, obtained by sensing all pixels of the blocks designated as the second block in response to the fine control signal FSS, to the timing controller 11.

The interpolation calculator 163*c* may generate the interpolated data IPSD by interpolating the first sensing data RSD for the first block.

The timing controller 11 may generate the grayscale values for the first pixels using the interpolated data IPSD and the second sensing data FSD.

Figure 20:
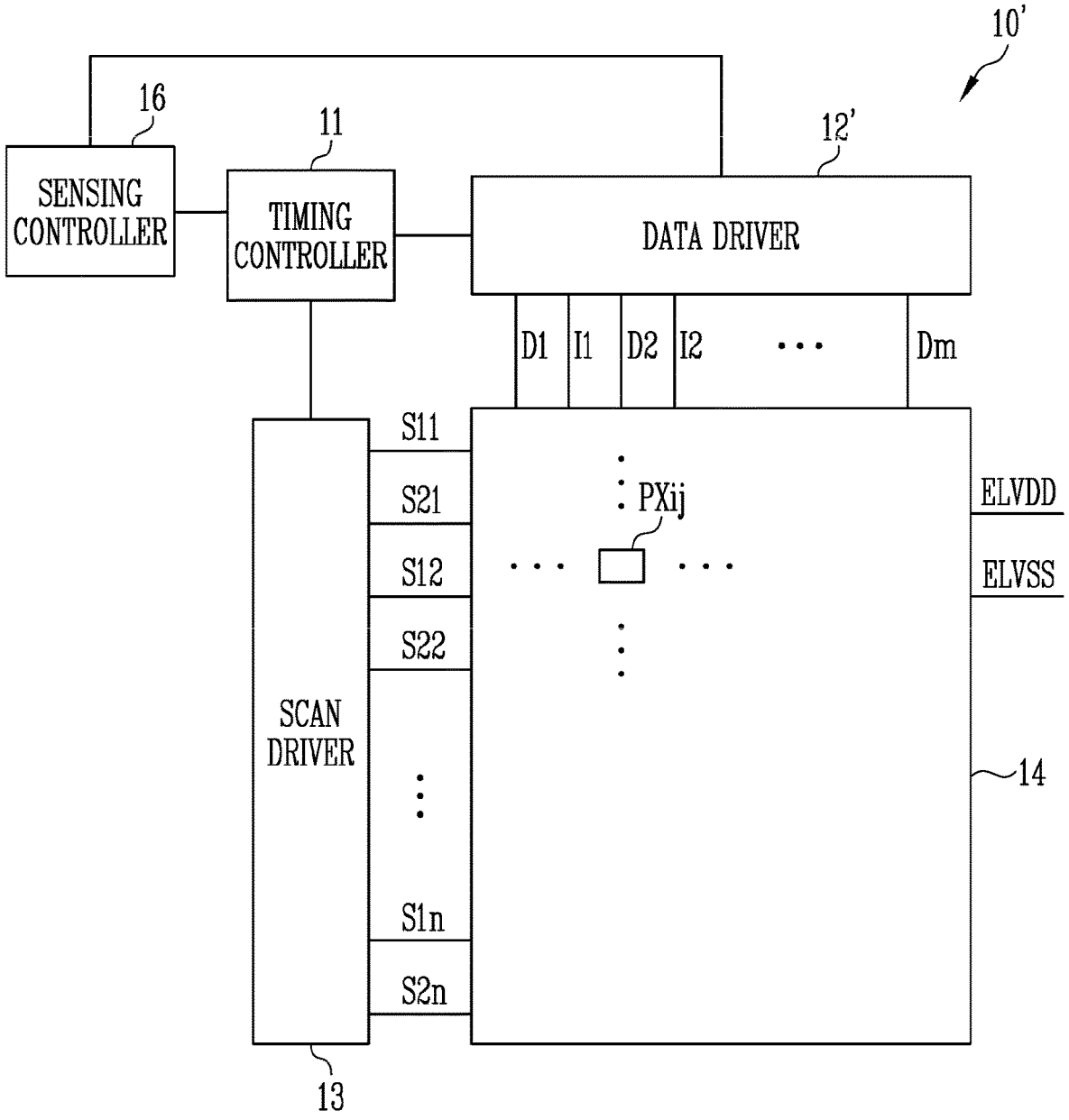
FIG. 20 is a diagram illustrating a display device according to an embodiment of the present disclosure.

FIG. 20 is a diagram illustrating a display device according to an embodiment of the present disclosure.

A display device 10' may include the timing controller 11, a data driver 12', the scan driver 13, the pixel component 14, and the sensing controller 16.

The data driver 12' of the display device 10' of FIG. 20 may be configured by integrating the data driver 12 and the sensor 15 of the display device 10 of FIG. 1. That is, in the display device 10 of FIG. 1, the data driver 12 and the sensor 15 may be implemented as separate integrated circuit (IC) chips, but the data driver 12' of the display device 10' of FIG. 20 that integrates the sensor 15 of the display device 10 of FIG. 1 may be implemented as a single IC chip.

Therefore, the data driver 12' may be coupled to the data lines D1, D2, . . . , Dm and the sensing lines I1 and I2. For example, the data lines D1, D2, . . . , Dm and the sensing lines I1 and I2 may be alternately arranged.

The display device and the method of driving the display device according to the present disclosure may accurately sense characteristic information of pixels while reducing the time required to sense the characteristic information.

The drawings and the detailed description of the present disclosure are examples and are merely provided for illustrative purpose, rather than limiting or restricting the scope of the present disclosure. Therefore, it will be appreciated to those skilled in the art that various modifications may be made, and other embodiments are available without deviating from the scope of the present disclosure.

What is claimed is:

1. A display device, comprising:

first pixels partitioned into a plurality of blocks, each of the plurality of blocks being categorized as a first block or a second block;

a sensor configured to generate first sensing data for at least two of the first pixels in each of the plurality of blocks during a first period; and a sensing controller configured to generate interpolated data for the first pixels that are not sensed by the sensor by interpolating the first sensing data, for the first block, and configured to forgo interpolation of the first sensing data, for the second block, wherein the sensor generates second sensing data for the first pixels that are not sensed by the sensor, for the second block, during a second period after the first period.

2. The display device according to claim 1, wherein the first pixels have a first color.

3. The display device according to claim 2, further comprising:

second pixels of a second color that is different from the first color; and third pixels of a third color that is different from the first color and the second color, wherein one of the first pixels, one of the second pixels, and one of the third pixels are coupled to the sensor through a common sensing line.

4. The display device according to claim 1, wherein the sensing controller comprises:

a representative block value calculator configured to calculate a representative block value of the first sensing data, for each of the plurality of blocks;

a fine sensing decider configured to categorize each of the plurality of blocks as one of the first block and the second block based on the representative block value; and an interpolation calculator configured to generate the interpolated data by interpolating the first sensing data for the first block.

5. The display device according to claim 4, wherein the representative block value is at least one of a standard deviation value, an average value, a maximum value, and a minimum value of the first sensing data, for each of the plurality of blocks.

6. The display device according to claim 5, wherein the fine sensing decider is configured to categorize each of the plurality of blocks as the second block based on the standard deviation value being greater than a block threshold value, and categorize each of the plurality of blocks as the first block based on the standard deviation value being less than or equal to the block threshold value.

7. The display device according to claim 4, wherein the interpolation calculator generates first interpolated data, among the interpolated data, using the first sensing data, and generates second interpolated data using the first interpolated data.

8. The display device according to claim 4, wherein the interpolation calculator generates first interpolated data, among the interpolated data, using the first sensing data, and generates second interpolated data using the first interpolated data and the first sensing data.

9. The display device according to claim 1, further comprising:

a timing controller configured to generate grayscale values for the first pixels using the interpolated data and the second sensing data.

10. A display device, comprising:

first pixels;

a lookup table including stress values for the first pixels, wherein a stress value of a first pixel is a cumulative value indicating a level of stress applied to the first pixel based on at least one of an amount of current flowing through the first pixel, an ambient temperature of the first pixel, and a grayscale represented by the first pixel;

a sensor configured to generate sensing data for at least some of the first pixels; and a sensing controller configured to generate interpolated data for at least some of the first pixels that are not sensed by interpolating the sensing data with reference to the stress values.

11. The display device according to claim 10, wherein the first pixels have a first color.

12. The display device according to claim 11, further comprising:

second pixels of a second color that is different from the first color; and third pixels of a third color that is different from the first color and the second color, wherein one of the first pixels, one of the second pixels, and one of the third pixels are coupled to the sensor through a common sensing line.

13. The display device according to claim 10, wherein the sensing controller comprises:

an interpolation group designator configured to designate adjacent first pixels in an interpolation group based on the stress values having a difference therebetween less than or equal to a stress threshold value; and an interpolation calculator configured to generate the interpolated data for respective ones of a plurality of interpolation groups.

14. The display device according to claim 10, wherein:

the first pixels are partitioned into a plurality of blocks, and the sensing controller comprises:

a fine sensing decider configured to categorize each of the plurality of blocks as one of a first block and a second block based on a representative stress value of the stress values, for each of the plurality of blocks; and an interpolation calculator configured to generate the interpolated data by interpolating the sensing data for the first block.

15. The display device according to claim 14, wherein the representative stress value is at least one of a standard deviation value, an average value, a maximum value, and a minimum value of the stress values, for each of the plurality of blocks.

16. The display device according to claim 15, wherein the fine sensing decider is configured to categorize each of the plurality of blocks as the second block based on the standard deviation value being greater than a stress threshold value, and categorize each of the plurality of blocks as the first block based on the standard deviation value being is less than or equal to the stress threshold value.

17. The display device according to claim 16, wherein the sensor generates first sensing data for at least two of the first pixels that belong to the first block, and generates second sensing data for all of the first pixels that belong to the second block.

18. A method of driving a display device including pixels partitioned into a plurality of blocks, the method comprising:

generating first sensing data for at least two of pixels in each of the plurality of blocks during a first period;

generating interpolated data for a first group of pixels that are not sensed by interpolating the first sensing data, for a first block among the plurality of blocks; and generating second sensing data for a second group of pixels that are not sensed for a second block among the plurality of blocks during a second period after the first period.

19. The method of claim 18, further comprising:

calculating a representative block value of the first sensing data, for each of the plurality of blocks; and categorizing each of the plurality of blocks as one of the first block and the second block based on the representative block value, wherein the representative block value is at least one of a standard deviation value, an average value, a maximum value, and a minimum value of the first sensing data, for each of the plurality of blocks.

20. The method of claim 19, wherein categorizing each of the plurality of blocks as one of the first block and the second block comprises categorizing each of the plurality of blocks as the second block based on the standard deviation value being greater than a block threshold value, and categorizing each of the plurality of blocks as the first block based on the standard deviation value being less than or equal to the block threshold value.

21. A method of driving a display device including pixels, the method comprising:

generating sensing data for at least some of the pixels; and generating interpolated data for a pixel that is not sensed by interpolating the sensing data with reference to a stress value, wherein the stress value is a cumulative value indicating a level of stress applied to the pixel based on at least one of an amount of current flowing through the pixel, an ambient temperature of the pixel, and a grayscale represented by the pixel.

* * * * *